US011300381B2

(12) United States Patent
Bernkrant et al.

(10) Patent No.: US 11,300,381 B2
(45) Date of Patent: Apr. 12, 2022

(54) SMART WEAPON HOLSTER

(71) Applicants: Keith Bernkrant, Cape Canaveral, FL (US); Paul Richter, Titusville, FL (US)

(72) Inventors: Keith Bernkrant, Cape Canaveral, FL (US); Paul Richter, Titusville, FL (US)

( * ) Notice: Subject to any disclaimer, the term of this patent is extended or adjusted under 35 U.S.C. 154(b) by 181 days.

(21) Appl. No.: 15/774,297

(22) PCT Filed: Feb. 19, 2017

(86) PCT No.: PCT/US2017/018554

§ 371 (c)(1),
(2) Date: May 8, 2018

(87) PCT Pub. No.: WO2017/117617

PCT Pub. Date: Jul. 6, 2017

(65) Prior Publication Data

US 2019/0137215 A1 May 9, 2019

Related U.S. Application Data

(63) Continuation-in-part of application No. PCT/US2016/018813, filed on Feb. 19, 2016, which
(Continued)

(51) Int. Cl.
*F41C 33/04* (2006.01)
*F41C 33/02* (2006.01)

(52) U.S. Cl.
CPC ..... *F41C 33/029* (2013.01); *F41C 33/0263* (2013.01); *F41C 33/04* (2013.01)

(58) Field of Classification Search
CPC ..... F41C 33/029; F41C 33/0263; F41C 33/04
(Continued)

(56) References Cited

U.S. PATENT DOCUMENTS 3,669,325 A 6/1972 Furman
3,688,953 A 9/1972 Bianchi
(Continued)

FOREIGN PATENT DOCUMENTS

WO 2014147616 9/2014

OTHER PUBLICATIONS

Supplemental European Search Report, European Patent Application No. 17733955.3, dated Jul. 10, 2019.
(Continued)

*Primary Examiner* — Suzanne L Barrett
(74) *Attorney, Agent, or Firm* — Lowndes; Stephen C. Thomas

(57) ABSTRACT

A smart holster for a firearm or other valuable, which may be worn on a belt, comprising and enclosure having an interior volume and containing an opening in a surface thereof, a retractable cover for covering the opening when the retractable cover is in a non-retracted position, a firearm retaining mechanism disposed within the interior volume; a firearm extending mechanism disposed within the interior volume; and a releasable latch for maintaining the firearm extending mechanism in a retracted position. A user may manually retract the cover causing a firearm contained within the interior volume to be extended for easy access. Geolocation, status and other information may be communicated to a remote user through a wireless data link. A camera may be activated by retracting the cover were upon video data may be transmitted to a remote monitor. The smart holster may be remotely locked or unlocked.

46 Claims, 18 Drawing Sheets

Related U.S. Application Data is a continuation-in-part of application No. PCT/US2015/051285, filed on Sep. 21, 2015, which is a continuation-in-part of application No. 15/544,738, filed on Jul. 19, 2017, now Pat. No. 10,494,856.

(60) Provisional application No. 62/119,099, filed on Feb. 20, 2015, provisional application No. 62/274,367, filed on Jan. 3, 2016, provisional application No. 62/105,201, filed on Jan. 19, 2015.

(58) Field of Classification Search
USPC ..... 70/426
See application file for complete search history.

(56) References Cited

U.S. PATENT DOCUMENTS 3,707,250 A 12/1972 Esposito
3,731,858 A 5/1973 Baker
4,273,276 A 6/1981 Perkins
4,277,007 A 7/1981 Bianchi et al.
4,298,150 A 11/1981 Seldeen
4,312,466 A 1/1982 Clark
4,318,503 A 3/1982 Capano
4,325,505 A 4/1982 Hillman
4,325,506 A 4/1982 Lindell et al.
4,378,082 A 3/1983 Chica
4,410,118 A 10/1983 Taurisano
4,463,884 A 8/1984 Parlante
4,471,894 A 9/1984 Neely
4,480,776 A 11/1984 Atkins, Sr.
4,485,947 A 12/1984 Cook
4,485,948 A 12/1984 Cook
4,542,841 A 9/1985 Bianchi et al.
4,591,081 A 5/1986 Bianchi et al.
4,620,654 A 11/1986 Cook
5,416,472 A 5/1995 Torii, Jr.
5,416,826 A 5/1995 Rutler
5,479,149 A * 12/1995 Pike ..... F41C 33/0209 340/539.1
5,779,114 A * 7/1998 Owens ..... F41C 33/0209 224/193
5,828,301 A * 10/1998 Sanchez ..... F41C 33/0227 340/539.1
5,884,799 A 3/1999 Korber et al.
6,276,735 B1 8/2001 Champion
6,523,374 B1 2/2003 Owens
6,533,149 B2 * 3/2003 Vor Keller ..... F41A 17/066 224/244
6,588,635 B2 7/2003 Vor Keller et al.
6,918,519 B2 * 7/2005 Vor Keller ..... E05B 47/0603 224/188
7,168,198 B2 * 1/2007 Newkirk ..... F41A 17/06 42/70.01
7,200,965 B2 4/2007 Vor Keller et al.
9,666,056 B2 * 5/2017 Herrera ..... F41C 33/029
9,739,555 B2 * 8/2017 Milde, Jr. ..... F41A 17/46
9,743,277 B2 * 8/2017 Lin ..... H04W 4/025
9,829,275 B2 * 11/2017 Madrid ..... F41C 33/029
9,841,255 B2 12/2017 Koskan et al.
9,879,932 B2 * 1/2018 Milde, Jr. ..... F41A 17/063
9,879,944 B1 * 1/2018 Gish ..... F41C 33/029
9,910,515 B2 3/2018 Richards et al.
9,939,545 B2 4/2018 Herrera et al.
10,444,042 B1 * 10/2019 Radcliff ..... G01D 7/00
2001/0033228 A1 10/2001 Kisreman et al.
2002/0153396 A1 * 10/2002 French ..... F41C 33/0209 224/244
2003/0057122 A1 3/2003 Bushnell
2004/0066275 A1 4/2004 Mickler
2008/0061991 A1 * 3/2008 Urban ..... G08B 13/19695 340/573.1
2010/0321186 A1 * 12/2010 Crook ..... G08B 13/149 340/568.6
2014/0162584 A1 * 6/2014 Cope ..... H04W 4/90 455/404.1
2014/0176363 A1 * 6/2014 Lam ..... G01S 19/14 342/357.39
2014/0215881 A1 8/2014 Milde, Jr. et al.
2014/0215885 A1 * 8/2014 Sullivan ..... F41A 35/00 42/84
2014/0366419 A1 12/2014 Allan
2015/0285588 A1 * 10/2015 Irwin ..... F41C 33/0227 224/243
2015/0369559 A1 * 12/2015 Del Rosario ..... F41C 33/029 340/686.4
2016/0054080 A1 * 2/2016 Haimi ..... F41A 17/06 42/70.06
2016/0116253 A1 4/2016 Moon
2017/0059274 A1 * 3/2017 Crist ..... F41A 17/06
2017/0160041 A1 * 6/2017 Stewart ..... F41A 35/00
2018/0231349 A1 * 8/2018 Wagner ..... G08B 5/22
2019/0186868 A1 * 6/2019 Cordero Pardo ..... F41C 33/029
2020/0217613 A1 * 7/2020 Hatcher ..... G08B 21/24

OTHER PUBLICATIONS

European Patent Office, Application No. 17733955.3, First Office Action dated Apr. 3, 2020.
International Preliminary Report on Patentability, dated Aug. 31, 2017, PCT/US2016/018813, Securable Container.
International Search Report, dated Jan. 28, 2016, PCT/US2015/051285, Portable Safe.
China National Intellectual Property Administration, First Office Action dated Dec. 4, 2018, Application No. 201680022846.2.

* cited by examiner

Battery Indicator LED
Flowchart

SMART WEAPON HOLSTER

CROSS REFERENCE TO RELATED APPLICATIONS AND INCORPORATION BY REFERENCE

This international application, filed in the United Stated Receiving Office (USRO) of the United States Patent and Trademark Office (USPTO) under the Patent Cooperation Treaty (PCT), claims benefit of priority to PCT patent application International Application Number PCT/US16/18813 titled SECURABLE CONTAINER filed in the USRO on Feb. 19, 2016, which is incorporated herein by reference in its entirety; which claimed the benefit of PCT/US15/51285 titled PORTABLE SAFE, filed in the USRO on Sep. 21, 2015 which is incorporated herein by reference in its entirety; and claimed the benefit of U.S. Provisional Application Ser. No. 62/119,099 titled PORTABLE SAFE, filed in the USPTO on Feb. 20, 2015 which is incorporated herein by reference in its entirety; and which claimed benefit of U.S. Provisional Application Ser. No. 62/274,367 titled SECURABLE CONTAINER, filed in the USPTO on Jan. 3, 2016, which is incorporated herein by reference in its entirety. This international application also claims the benefit of the following applications: PCT/US15/51285 titled PORTABLE SAFE, filed in the USRO on Sep. 21, 2015 which is incorporated herein by reference in its entirety; U.S. Provisional Application Ser. No. 62/119,099 titled PORTABLE SAFE, filed in the USPTO on Feb. 20, 2015 which is incorporated herein by reference in its entirety; and U.S. Provisional Application Ser. No. 62/274,367 titled SECURABLE CONTAINER, filed in the USPTO on Jan. 3, 2016, which is incorporated herein by reference in its entirety.

Any patent, patent application, or document referenced in this application is hereby incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

TECHNICAL FIELD

The invention relates generally to the field of holsters for weapons such as may be, but are not necessarily, carried on a person's body. The field of the invention also includes holsters that may be remotely accessible. More specifically, a preferred embodiment and best mode of the invention is directed to a holster, such as a holster for a handgun, conducted electrical weapon or other firearm or weapon. In an embodiment the invention is adapted to carry a firearm secured in a holster, where it may be safely carried and contained in a lockable condition but which in which the firearm is readily accessible to aid in personal defense or in any tactical situation. The smart holster of the invention may be used to carry any object desired by the user, i.e., not just a firearm.

While a preferred embodiment and best mode of the smart holster of the invention is an embodiment resembling a holster, such as a holster for firearm that may be worn by a person for example on a belt, the holster of the invention may take any physical form or shape and is not to be construed as being limited to only a holster that is wearable by a person or that has the specific shape or configuration depicted in the figures of the drawings. For example, the holster of the invention may be utilized for carrying valuables or a firearm in a vehicle, motorhome, boat, home, or in virtually any environment in which a user may wish to carry such items in a secure and controlled manner.

BACKGROUND ART

It is often desirable that valuable items such as, for example, firearms, be securely carried on or with a person without revealing that the user is carrying such items. Furthermore, it is often desirable that the condition, status, or location of the firearm be ascertainable by a monitoring station, or that the holster in which it is carried be remotely lockable.

Various holsters have been developed that may hold a firearm in various locations on a person's body, for example outside (open carry) or inside the waistband of the wearer's pants or on or near the wearer's chest, such as a shoulder harness worn under the user's clothing. These apparatuses and methods for carry of firearms or other weapons are generally subject to certain drawbacks. For instance, inside-the-waistband holsters may be uncomfortable, may require unfashionable clothing or, if the user's clothing is too tight, may show, or "print", the outline of the firearm and thereby alert others in the vicinity that the user is carrying a concealed weapon. An additional drawback of inside-the-waistband holsters is that they may impede the drawing the firearm in an emergency if they shift during wearing or if the user's pants are constricted. Alternatively, shoulder harnesses may be worn for carry of a firearm, but these must generally be worn under the user's shirt or outer garment. If worn under the outer garment, which may be for example a coat, the user is prevented from removing the outer garment because the firearm may be revealed. If worn under an inner garment such as a shirt, the drawing the firearm may be impeded due to the fact that the firearm is beneath the wearer's shirt. Another drawback of the concealed carry holsters of the prior art is that they may not be lockable so as to prevent unauthorized access to a firearm or valuable object(s) stored in them. And, in any event, the holsters of the prior art are not remotely lockable, nor do they provide status of the firearm being carried, nor do they provide geolocation information to a remote user such as a monitoring station. However, such features are desirable for any number of situations, such as, for example and not by way of limitation, in law enforcement use.

What is needed in the art, therefore, is an apparatus and/or method such as a container or holster that is adapted to carry firearms in such a manner that they may be securely carried by a user, while allowing for quick and easy removal of the firearm when desired by a user. It would further be desirable that such a holster be lockable by a user, either locally or remotely, that the holster be capable of reporting its geolocation and status to a remote user, and that the holster, trigger the operation of certain safety or information-gathering devices such as cameras (e.g. body cameras) or microphones when the firearm is removed from the holster.

BRIEF DESCRIPTION OF THE INVENTION

The present invention comprises an apparatus and method that have one or more of the following features and/or steps, which alone or in any combination may comprise patentable subject matter.

The present invention overcomes the shortcomings of the prior art in that it provides an apparatus and method for a holster that allows the carrying of firearms such that they may be securely carried by a user while allowing for quick and easy removal when desired by a user; is remotely lockable; and may provide geolocation information to a remote monitoring station. Removal of a firearm from the holster may trigger the operation of certain safety or information-gathering devices such as cameras or microphones when the firearm is removed from the holster. Such microphones or cameras which may be in electrical wired or wireless communication with the holster or may independently be in wireless communication with a remote monitoring station. In this manner, a user may withdraw a firearm from the holster, triggering operation of one or more cameras or microphones, or both, for the transmittal of video, still images, audio data or other information to a remote monitoring station. In an embodiment, both video and audio data may be transmitted to a remote monitoring station. The audio or video information, or both, may also be stored in the holster electronics in a computer readable or or other media. Thus, video and/or audio data may be transmitted, for example, to a law enforcement monitoring station such as a headquarters or station house, where a police officer's tactical situation may be observed by others such as superior officers or tactical specialists. The cameras may be worn by the law enforcement officer or may located remotely from the law enforcement office, and may be adapted to provide a 360° view, enabling the remote monitoring station to view an area around the officer that provides a complete tactical view. Also, the remote monitoring station at the station house may remotely lock the holster of the invention, preventing unauthorized access to a law enforcement officer's firearm. This feature may be helpful for example when a law enforcement officer has been incapacitated and may thus prevent unauthorized access and/or use of the officer's firearm when the officer is unable to prevent such unauthorized access themselves.

In accordance with one embodiment of the present invention, the invention comprises a holster that may comprise an optional geolocation receiver such as a GPS receiver for geolocation of the smart holster and its contents; a processor for executing non transitory computer executable instructions scored in a computer readable medium such as an electronic memory, and may comprise one or more means for communication with a remote user or system, such as a remote user data interface that may include radiofrequency wireless or optical communications transceivers, wired data communications ports such as Universal Serial Bus (USB) and the like, in any combination and in any number. A remote user may be able to track the geographic location of a holster of the invention and its contents by utilizing received geo-positioning information, such as through a GPS receiver, or cell-based geolocation information, that is reported from the smart holster of the invention to a remote user; or geolocation information regarding the geographic location of the smart holster may be independently reported from cell towers and data network systems to which the smart holster is wirelessly connected through radiofrequency or any other wireless communications means such as, for instance and not by way of limitation, cellular communication systems such as Global System for Mobile Communications, or GSM; analog data networks; wireless Local Area Networks (LANs) such as Wi-Fi; point to point communication systems such as Bluetooth®; or any other radiofrequency or optical communication systems known in the art. The smart holster may also report its condition and/or status, such as "weapon holstered", "weapon un-holstered", "holster locked" or "holster unlocked" to a user such as a remote user communicating with the holster via a wireless network in communication with the world wide web.

In accordance with an embodiment of the smart holster of the invention, the holster comprises a controllable locking mechanism of the invention which may be an electromechanical apparatus in electrical communication with a controller so that the holster may be controlled or commanded into a locked or an unlocked state. When the controllable locking mechanism is in a locked state the weapon is prevented from being removed from the holster by the operation of a latching mechanism, which may be, for example, a bail mechanism. The controllable locking mechanism may be commanded by the controller into a "locked" state or an "unlocked" state by the controller. The controller may be instructed to command the controllable locking mechanism by a remote monitoring station or user using a wireless interface to communicate with the controller, which interface may be an optical or a radiofrequency wireless interface. For example, the lock or unlock instruction may be generated by a user using a keyfob or a mobile computing device such as an electronic tablet or cell phone, or the command may be generated by a user or remote monitoring station using a personal computer or any other electronic device that is in communication with the processor through the world wide web or any communication channel. The holster of the invention, as described further below, may further comprise a controller in communication with one or more radiofrequency or optical transceivers, or both, such that the holster is connected to the Internet and is addressable using, for example, an Internet protocol address. Thus, a user may enter a command from a remote electronic device, which command is transmitted through the Internet and received by a communication port of the holster, and then communicated to the controller within the holster. The controller may then execute computer readable and executable non-transitory instructions to process the command received from the remote user to command the controllable locking mechanism into a locked or unlocked condition. The holster may further be commanded into a locked condition when a device such as a key fob is no longer within operable distance as described further below.

Any embodiment of the invention may further comprise geo-positioning electronic components such as a geolocation receiver, which may be a Global Position System (GPS) receiver, capable of receiving geo-locating signals from, for example, remote transmitters such as, but not limited to, GPS or other geo-positioning satellites, processing said geo-locating signals, and transmitting a signal comprising geolocation information through a remote user data interface to a remote user who, for example, may communicate with a smart holster of the invention through a world wide web interface on the internet that is in data communication with the smart holster through the user data interface. The holster may further comprise a controller capable of executing non-transitory computer executable instructions stored in a non-transitory computer readable medium that is in communication with the controller; a battery or other power source in electrical communication with the controller and non-transitory computer readable medium; and a wired electrical interface, which may be, for example an electrical communications port such as a Universal Serial Bus (USB) port or parallel data port in communication with the non-transitory computer readable medium and controller for programming the non-transitory computer readable medium by communicating computer executable instructions to the non-transitory computer readable medium for storage and later retrieval and execution by the controller. The controller and battery or other power source may be in electrical communication with the GPS receiver. Likewise, in an embodiment, the controller and battery or other power source may be in electrical communication with the electromechanical latch so that the controller may command the electromechanical latch into any of the states or conditions described herein.

In an alternate embodiment, the geolocation receiver may comprise a wireless transceiver such as an RF transceiver capable of communicating with a remote wireless receiver for the purpose of transmitting a signal comprising geolocation information to a remote receiver without the need to transmit the signal comprising geolocation information through a controller to a remote receiver. In this embodiment, the smart holster of the invention may thus comprise the ability to transmit a signal comprising geolocation information to a remote receiver without the need for a controller or separate wireless transceiver.

The present method and device of the invention overcome the shortcomings of the prior art by providing a holster for carrying items, for example, a weapon such as a firearm such that the firearm may be securely carried by a user, while allowing for quick and easy removal of the items or firearm when desired by a user. The holster may be lockable by a user or remote monitoring station, either locally or remotely; the holster may be capable of reporting its geolocation and status to a remote use; and the holster may trigger the operation of certain safety or information-gathering devices such as one or more cameras or microphones when a weapon is removed from the holster or on the occurrence of other condition such as if the holster is moved or becomes unlocked.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

In the figures of the drawings, like item numbers refer to like elements.

BEST MODE FOR CARRYING OUT THE INVENTION

Figure 1:
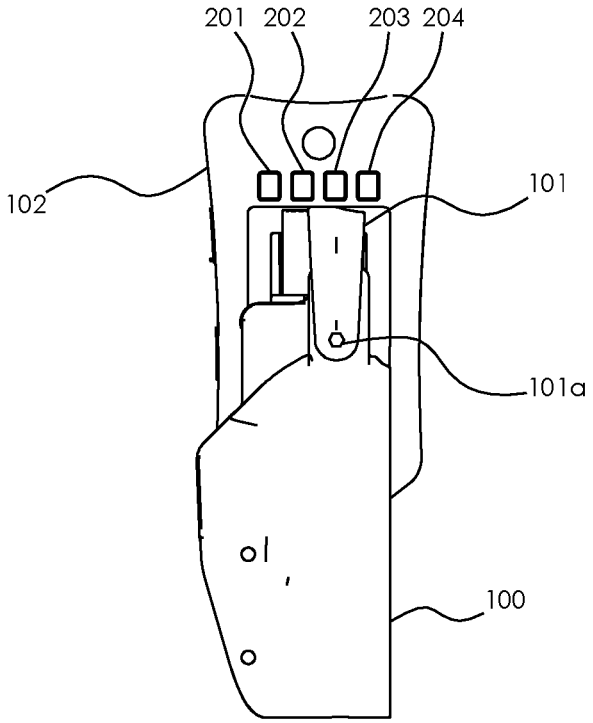
FIG. 1 depicts a side view of an embodiment of the smart holster of the invention.

The following documentation provides a detailed description of the invention. Although a detailed description as provided in the attachments contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention. Thus the scope of the invention should be determined by the appended claims, including any amendments thereto, and their legal equivalents, and not merely by the preferred examples or embodiments given. While the figures of the drawings depict the holster as being adapted to carry a weapon such as a firearm, the invention may be used to carry any other weapon, defensive device, communication device or any other item.

The invention comprises both the apparatus and the methods descripted herein.

As used herein, "memory", "medium", "media", "computer readable memory", "computer readable medium", "computer readable media", "storage media", "computer readable storage media" and "computer readable storage medium" shall include within their meanings only physical non-transitory computer readable hardware, and such terms shall specifically exclude signals per se, carrier waves, propagating signals and other transitory signals. Such physical non transitory computer readable media may comprise hardware memory that comprises a physical structure for storing data which may include computer executable instructions or data, and may be physically co-located in the same integrated circuit as the controller, or may be a separate device or devices.

As used herein, "remote user data interface" means one or any combination of wired or wireless communications interfaces known in the art including wired serial buses such as USB, RS-232 or other serial data interfaces; wired parallel data buses; radiofrequency or other wireless communications means such as, for instance and not by way of limitation, cellular communication systems such as CDMA or Global System for Mobile Communications, or GSM; analog data networks including cellular data networks; wireless Local Area Networks (LANs) such as the Institute of electrical and Electronic Engineers (IEEE) 802.11 standard known as Wi-Fi®; point to point communication systems such as Bluetooth®; infrared optical communications systems; RFID systems; Near Field Communication (NFC) systems or any other radiofrequency or optical communication systems known in the art in which a remote user can communicate with a local device either directly or through data interfaces with the world wide web.

As used herein, when referring to signals provided by switches, "provide a signal" may mean providing a switch closure or a switch open; in others words, both the presence of, and absence of, a voltage or other signal are within the meaning of "provide a signal".

As used herein, "weapon" may mean any weapon, but in an embodiment, includes within its meaning "firearm" and "pistol".

As used herein, with respect to the controller, "adapted to" means that the controller executes computer readable non-transitory instructions to carry out the subject function.

Referring now to FIG. 1, a side view of an embodiment of the smart holster of the invention is depicted. In this view, a weapon is not shown; i.e. the holster is depicted as empty. The latching mechanism bail 101 is depicted in the latched state. Holster receiver portion 100 is adapted to receive an item to be carried in the smart holster, for example, the barrel of a weapon such as a firearm. Push buttons 201, 202, 203 and 204, which form a part of input port 42 (not shown in FIG. 1 but shown in FIG. 8), and electronics housing 102 are depicted for reference. 101*a* is a bail rotational axis. When bail 101 is rotated to the unlatched state as depicted further in FIGS. 4 and 5, it rotates about this axis. However it is understood that the latching mechanism comprising a bail 101 as depicted is one of many embodiments of the latching mechanism.

Figure 2:
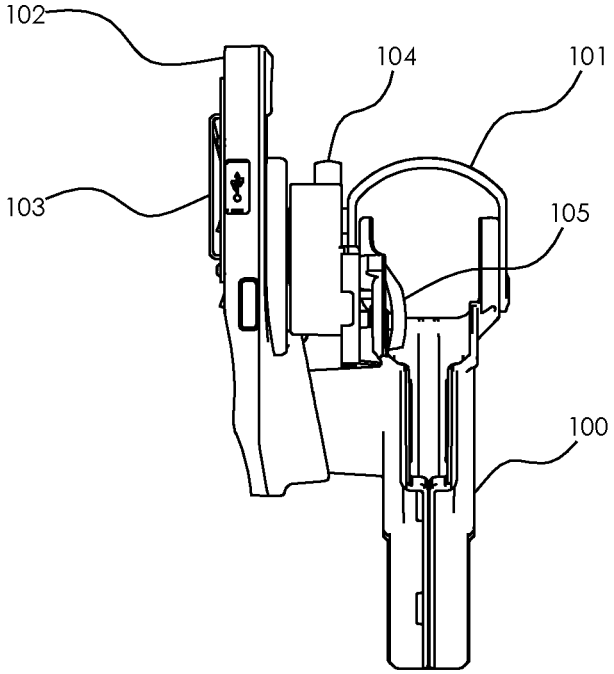
FIG. 2 depicts a rear view of an embodiment of the smart holster of the invention further showing a belt clip for use by a user in carrying the smart holster on the body of the user.

Referring now to FIG. 2, depicts a rear view of an embodiment of the smart holster of the invention further showing a clip 103 for use by a user in carrying the smart holster on the body of the user is depicted. In this view, a weapon is not shown; i.e. the holster is depicted as empty. The latching mechanism bail 101 is depicted in the latched state. Clip 103 is adapted to be clipped onto a structure such as, by way of example and not limitation, a belt of a user, and may further comprise a clip sensor that produces a signal comprising information as to whether or not clip 103 is clipped onto a structure. It is to be understood that belt carry is just one of many uses of the smart holster of the invention, and that the smart holster may be utilized in a vehicle, boat, motorhome, home, or any other environment desired. In such uses, the smart holster may be attached to an interior surface of a vehicle, such as the side of a console or other structure. Clip 103 may comprise a belt clip open/close sensor 807 in the form of electrical contacts that are a closed electric circuit when no material, such as belt, is disposed between the members of belt clip 103, and which are an open electric circuit when material is disposed between the members of belt clip 103 such as when the smart holster is worn on the belt of a user such the user's belt is disposed between the members of belt clip 103. Electronics housing 102, latch release button 104, weapon present sensor button 105 and holster receiver portion 100 are depicted for reference.

Figure 3:
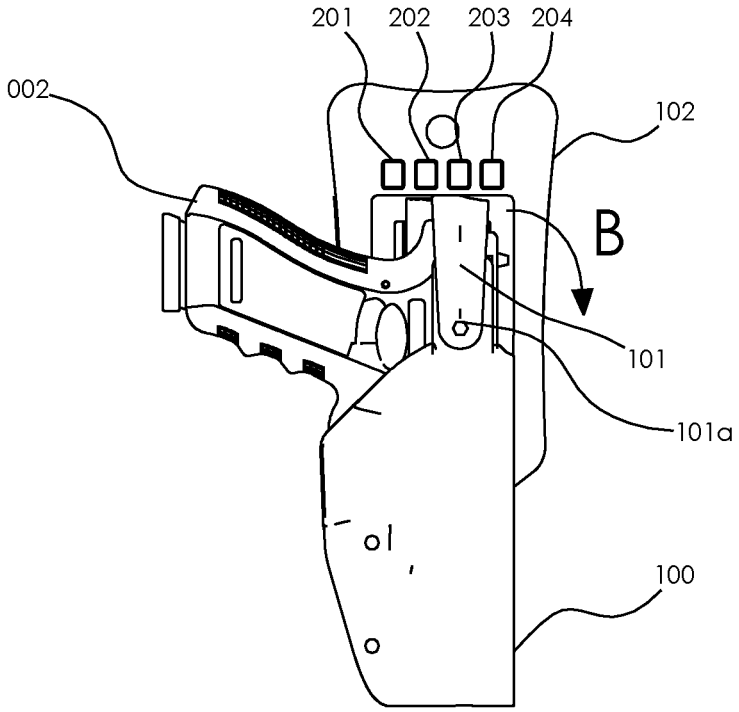
FIG. 3 depicts a side view of an embodiment of the smart holster of the invention with an exemplary weapon inserted into the holster and the latching mechanism in a latched state, preventing the weapon from being removed from the smart holster.
Figure 4:
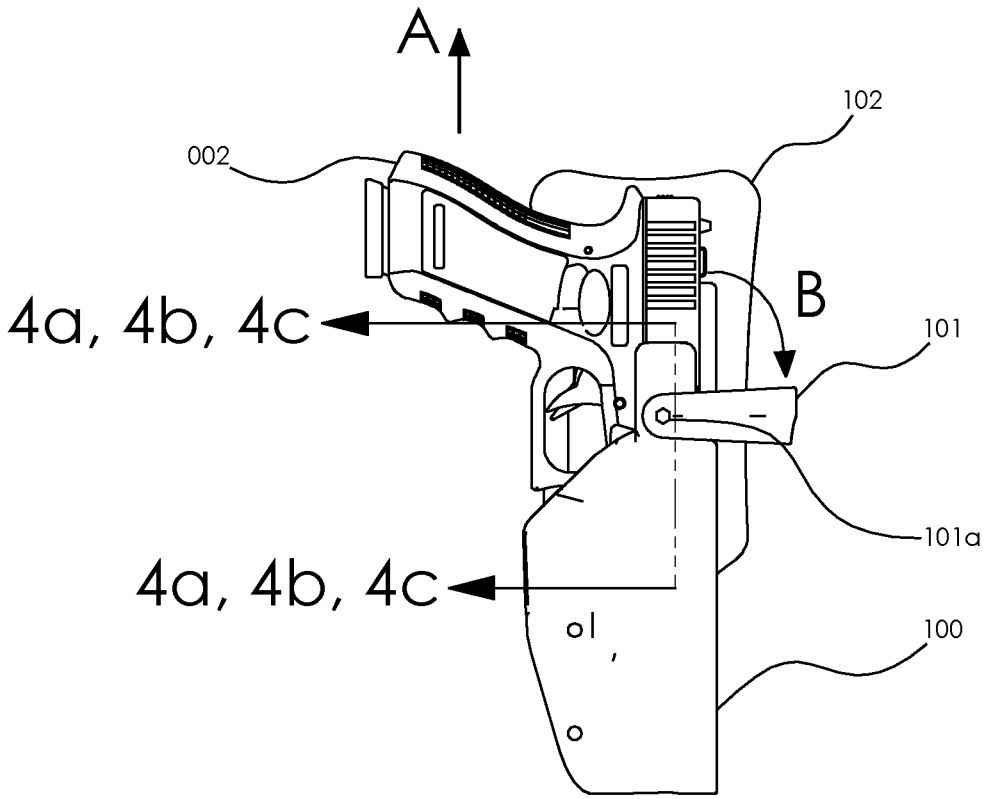
FIG. 4 depicts a side view of an embodiment of the smart holster of the invention with an exemplary weapon in the process of being removed. In this figure, the latching mechanism is depicted in an unlatched state.

Referring now to FIG. 3, a side view of an embodiment of the smart holster of the invention with an exemplary weapon inserted into and seated in the holster and the latching mechanism in a latched state, preventing the weapon from being removed from the smart holster, is depicted. Latching mechanism bail 101, which, in the embodiment shown, pivots about axis 101*a*, is depicted in the latched state in which it prevents exemplary weapon 002 from being removed from the holster receiver portion 100. If a user desires to remove weapon 002, first the locking mechanism must be commanded into an unlocked state, and then Latching mechanism bail 101 is rotated in the direction of arrow B to place the bail in the unlatched state (as depicted in FIG. 4.). Input port push buttons 201, 202, 203 and 204 form an input port for inputting a code to controller 800 (not depicted in FIG. 3 but depicted in FIG. 8). This input port may be used by a user to input a first code for causing the controller 800 to command the locking mechanism of the invention into a locked state, or for inputting a second code for causing the controller 800 to command the locking mechanism of the invention into an unlocked state. In an embodiment, the first code and the second code may be the same code. Housing 102, which may house an electronics assembly comprising some of the electronic components of the system, is shown for reference.

Referring now to FIG. 4, a side view of an embodiment of the smart holster of the invention with an exemplary weapon in the process of being removed is depicted. In this figure, the latching mechanism bail 101 is depicted in an unlatched state, having been rotated from the latched state in the direction of arrow B, placing latching mechanism bail 101 in the unlatched state. In this unlatched, state, exemplary weapon 002 may be removed from the holster by a user grasping weapon 002 and translating the weapon in the direction of arrow A, up and out of the holster. In FIG. 4, weapon 002 has been partially translated in the direction of arrow A but has not cleared the holster yet. Likewise, when it is desired to return the weapon to the holster and secure it here, weapon 002 is inserted into the holster by translating it in a direction opposite to arrow A, and by next rotating latching mechanism bail 101 in a direction opposite arrow B until it reaches the latched position as shown in FIG. 3 and described above. Housing 102 is shown for reference. Section views 4*a*-4*a*, 4*b*-4*b*, and 4*c*-4*c* depict the operation of the weapon present sensor, which provides a signal to controller 800 (not shown in FIG. 4 but shown in FIG. 8) indicating whether a weapon is present in the holster.

Figure 4A:
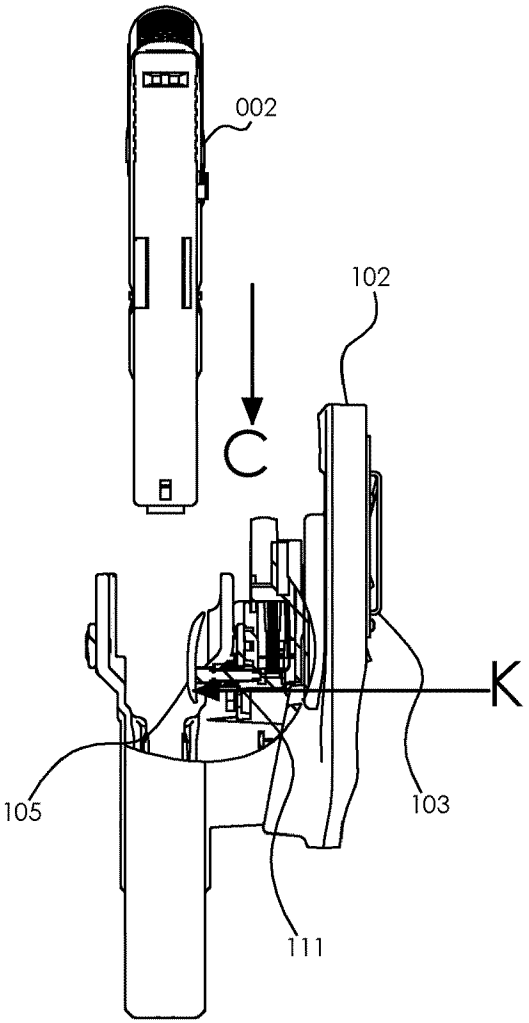
FIG. 4*a* depicts a front view of an embodiment of the smart holster of the invention with an exemplary weapon in the process of being inserted. In this figure, a partial cross section is depicted showing the state of the weapon present sensor when a weapon is not present in the holster. In this figure the weapon has not yet entered the holster.
Figure 8:
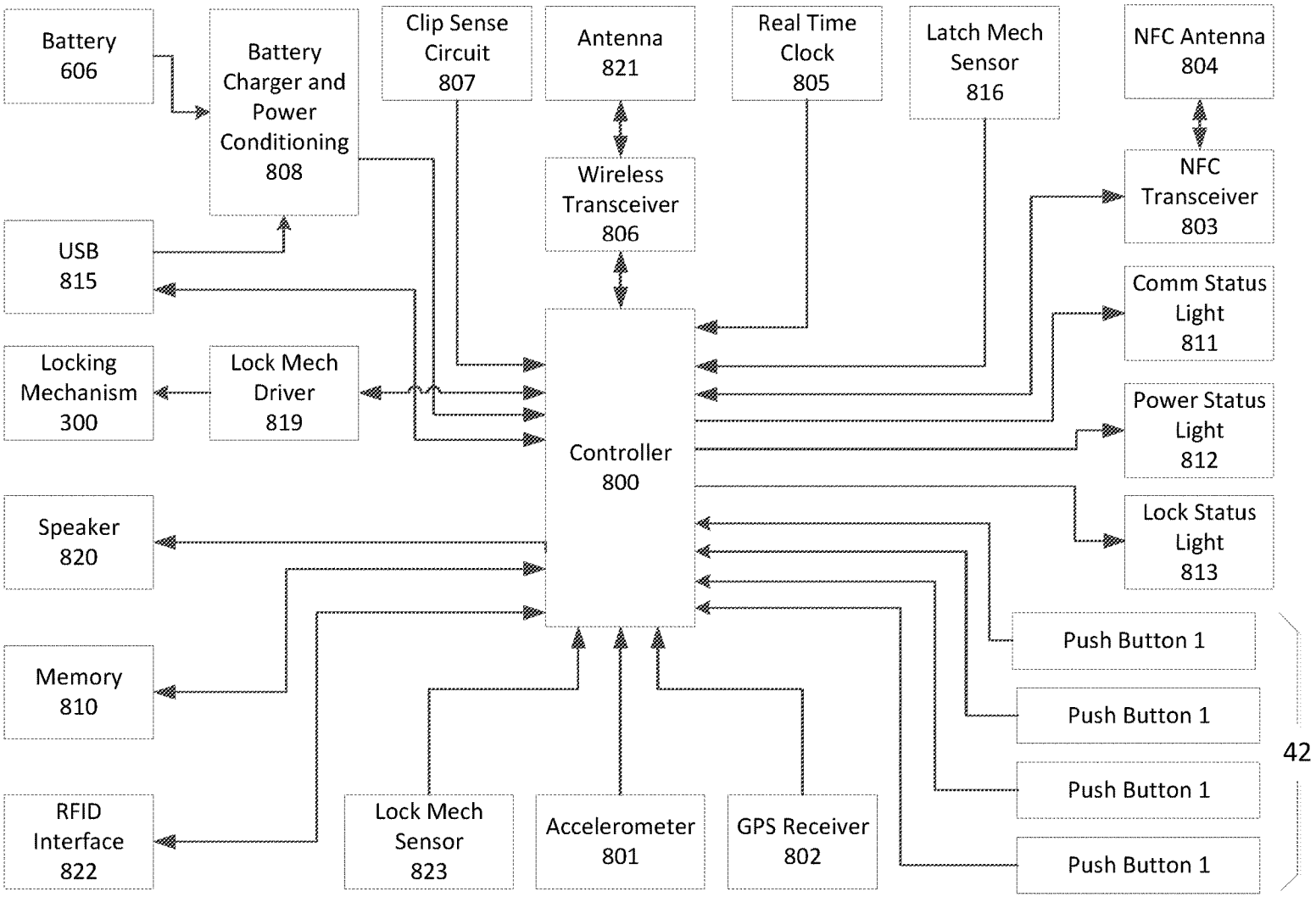
FIG. 8 depicts a block diagram of an embodiment of the smart holster of the invention.

Referring now to FIG. 4*a*, a front view of an embodiment of the smart holster of the invention with an exemplary weapon 002 in the process of being inserted into the holster is depicted. In this figure, a partial cross section is depicted showing the state of weapon present sensor button 105 when a weapon is not present in the holster is shown. In this figure weapon 002 has not yet entered the holster. When weapon 002 is not present in the holster, weapon present sensor button 105 is biased by a spring such as spring 111 or other mechanism so that it is pre-loaded in the direction of arrow K so that it protrudes into the path that weapon 002 will take when it is inserted into the holster by being translated in the direction of arrow C. Weapon present sensor button 105 forms part of a weapon present sensor, which in the embodiment depicted is an electromechanical switch operated by weapon 002 depressing weapon present sensor button 105 when weapon 002 is inserted into the holster, as depicted in FIG. 4*c*. The electromechanical switch, of which weapon present sensor button 105 is a part, is in communication with controller 800 (not show in FIG. 4*a* but is shown in FIG. 8), providing a sensor signal to controller 800 indicating whether or not weapon 002, or any other item desired to be carried in the holster, is present in the holster. Housing 102 and clip 103 are shown for reference.

Figure 4B:
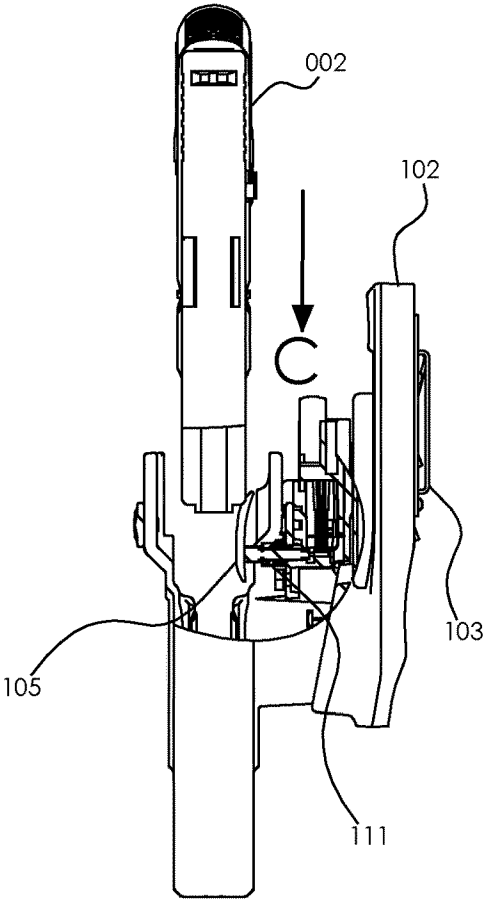
FIG. 4*b* depicts a front view of an embodiment of the smart holster of the invention with an exemplary weapon in the process of being inserted. In this figure, a partial cross section is depicted showing the state of the weapon present sensor when a weapon is not present in the holster. In this figure the weapon has just begun to enter the holster and has just begun to contact the weapon present sensor but has not yet activated the weapon present sensor.
Figure 4C:
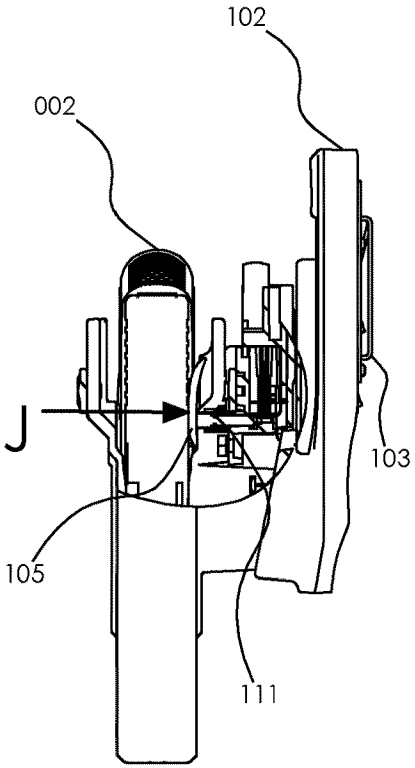
FIG. 4*c* depicts a front view of an embodiment of the smart holster of the invention with an exemplary weapon present in the holster after being inserted into said holster. In this figure, a partial cross section is depicted showing the state of the weapon present sensor when a weapon is present in the holster. In this figure the weapon is seated in the holster and is in full contact with the weapon present sensor, activating the weapon present sensor to indicate that the weapon has been holstered.

Referring now to FIG. 4*b*, a front view of an embodiment of the smart holster of the invention with an exemplary weapon 002 in the process of being inserted into the holster is depicted. In this figure, a partial cross section is depicted showing the state of weapon present sensor button 105 when a weapon is being inserted but is not yet seated in the holster is shown. In this figure weapon 002 has just entered the holster, but has not yet depressed weapon present sensor button 105, and weapon present sensor button 105 remains biased into the path that weapon 002 will take as it is seated in the holster as depicted in FIG. 4*c*. Thus in this figure, in which the electromechanical switch, of which weapon present sensor button 105 is a part, is signaling to controller 800 that there is no weapon present in the holster. Housing 102 and clip 103 are shown for reference.

Referring now to FIG. 4*c*, a front view of an embodiment of the smart holster of the invention with an exemplary weapon 002 present in the holster after being inserted into said holster. In this figure, a partial cross section is depicted showing the state of the weapon present sensor when a weapon 002 is present in the holster. In this figure the weapon is seated in the holster and is in full contact with the weapon present sensor button 105, depressing it in the direction of arrow J against the biasing force of spring 111 in the direction of arrow K (shown in FIG. 4*a*), activating the weapon present sensor to provide a signal to controller 800 that weapon 002 has been holstered. Housing 102 and clip 103 are shown for reference.

Figure 5:
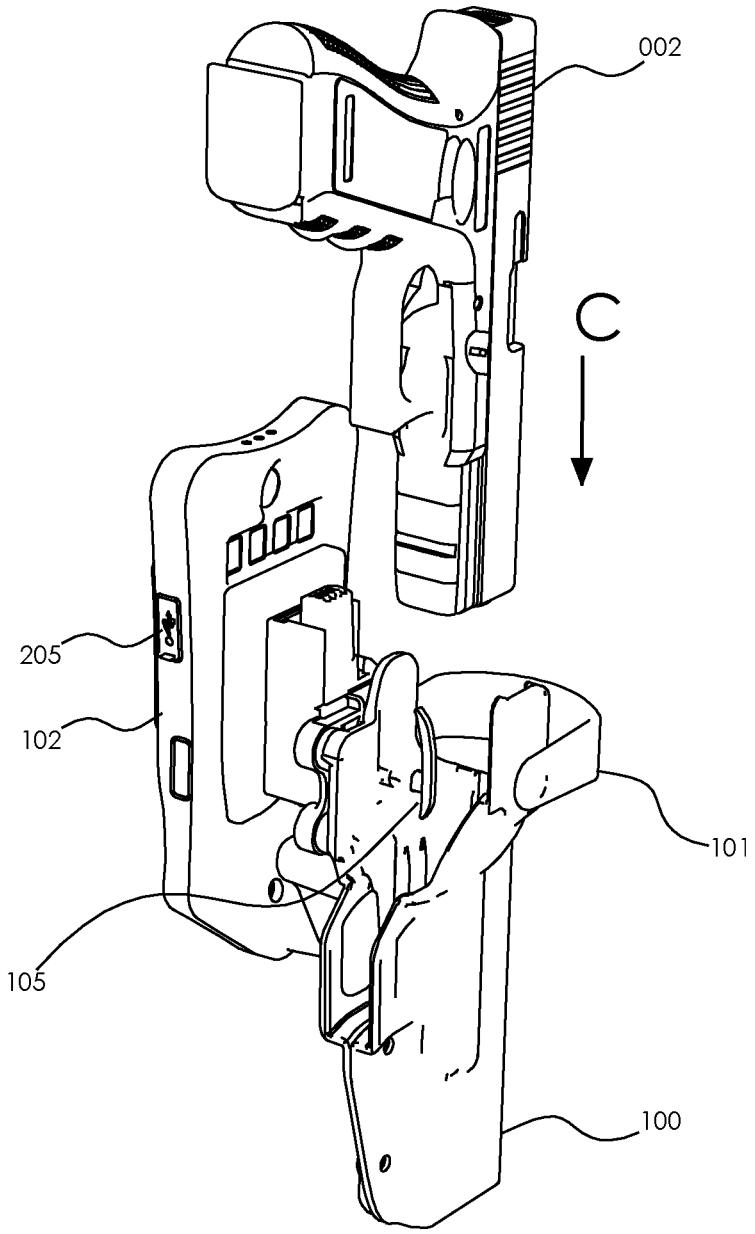
FIG. 5 depicts a perspective view of an embodiment of the smart holster of the invention, with an exemplary weapon being inserted into the holster, prior to the weapon entering the holster. The smart holster is depicted in an unlatched state.

Referring now to FIG. 5, a perspective view of an embodiment of the smart holster of the invention, with an exemplary weapon being inserted into the holster, prior to the weapon entering the holster. The smart holster is depicted in an unlatched state which latching mechanism bail 101 is depicted in an unlatched state and weapon present sensor button 105 has not been depressed, in other words in its biased state and is providing a signal to controller 800 that there is no weapon present in the holster. As weapon 002 is translated in the direction of arrow C into the holster, weapon present sensor button 105 will be depressed, causing the weapon present sensor switch to provide a signal to controller 800 that a weapon has been holstered. Housing 102, holster receiver portion 100 and USB port 205, which is communication with controller 800 (depicted in FIG. 8) are shown for reference.

While a specific embodiment of the weapon present sensor of the smart holster is depicted in FIGS. 4*a*-4*c* in which an electromechanical switch is closed when a weapon is inserted into the holster, the scope of the invention comprises other forms of sensors. For example, the weapon present sensor may be selected from the group consisting of an electromechanical switch, a proximity sensor, a magnetic switch, and an optical sensor in communication with controller 800, adapted to provide a signal to the controller indicating that a weapon is present in the holster. The proximity may be any proximity sensor but, in an embodiment, may be the type based on a coil and oscillator that creates an electromagnetic field in the close surroundings of the sensing surface and is operable to sense nearby metal.

Figure 6:
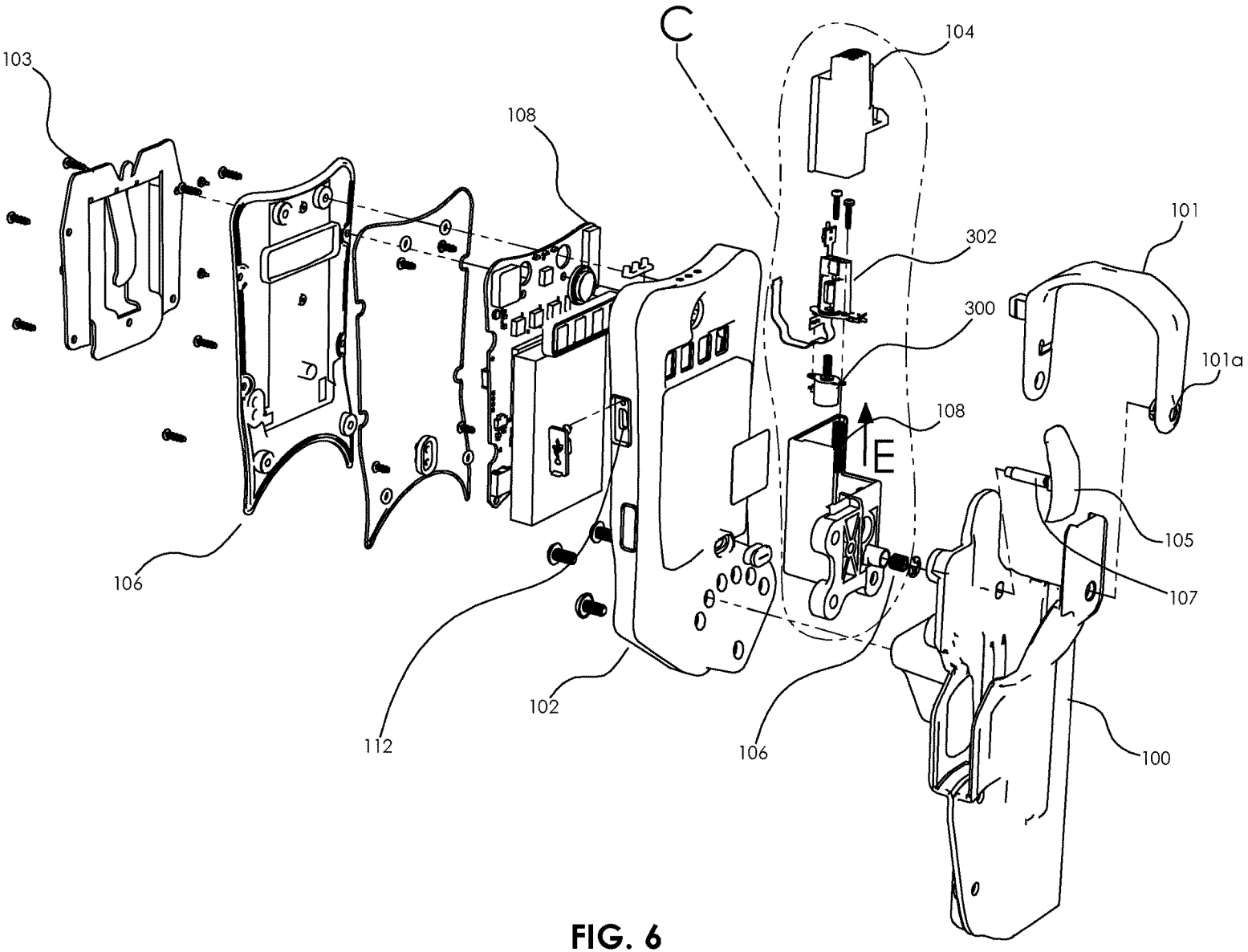
FIG. 6 depicts an exploded perspective view of an embodiment of the smart holster of the invention.

Referring now to FIG. 6, an exploded perspective view of an embodiment of the smart holster of the invention is depicted. Holster receiver portion 100 may be attached to housing 102 in a rotable manner by means of a plurality of holes in housing 102 for receiving a detent pin disposed on a surface of holster receiver portion 100. Weapon present sensor button 105, which forms a part of the weapon present sensor as hereinbefore described, is disposed on post 107 and is attached thereto such that it is pre-loaded in the direction of arrow K so that it protrudes into the path that weapon 002 will take when it is inserted into the holster by being translated in the direction of arrow C (see the description of FIG. 4*a* above). The spring 111 for pre-loading weapon present sensor button 105 and the switch closure mechanism of the weapon present sensor may be located in post 107. Latching mechanism bail 101, which is rotable about axis 101*a*, is rotably attached to surfaces of holster receiver portion 100, and may be, but is not necessary, pre-loaded by spring 106 to be biased towards an unlatched state as depicted in FIGS. 4 and 5. Spring 108 provides upward force E on latch release button 104, so that when a user wishes to place the smart holster of the invention into an unlatched state, a force H (shown in FIG. 7) is provided against latch release button 104, latching mechanism bail 101 is able to be rotated into the latched state as shown in FIGS. 4 and 5. In embodiments of the holster in which a biasing force is provided tending to bias latching mechanism bail 101 towards an unlatched state as depicted by arrow B in FIG. 4, the depressing of latch release button 104 allows latching mechanism bail 101 to automatically rotate to the unlatched state.

Still referring now to FIG. 6, an exemplary locking mechanism of the embodiment of the smart holster depicted comprises motor 300 which is in electrical communication with controller 800 such that it can be commanded to operate, and lock housing 302. The operation of the locking mechanism is further depicted in FIG. 7. USB port 606 is in communication with controller 800 (depicted in FIG. 8). Housing 102 and back plate 106 together form an enclosure for electrical and electronic components of the smart holster, some of which may be, but are not necessarily, disposed on a printed wiring board such as shown as item 108 or other structure providing mounting means and, in embodiments, providing electrical connection means so that the electrical and electronic components of the system are in communication as described herein. It is not necessary that a printed wiring board be used for this purpose: the electrical and electronic components of the system may be mounted and in communication as depicted in the figures and described herein by any means known in the art.

Figure 7:
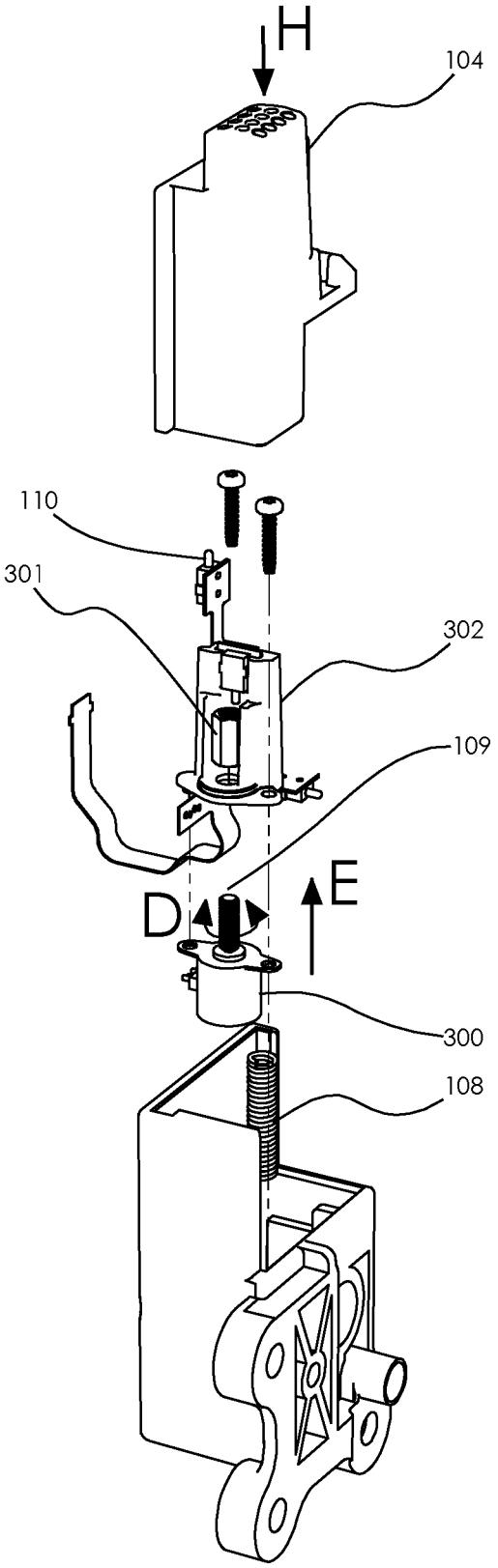
FIG. 7 depicts an exploded perspective view of an embodiment of the controllable locking mechanism of the invention.

Referring now to FIG. 7, an exploded perspective view of an embodiment of the controllable locking mechanism of the invention is depicted. As described above, the rotation of latching mechanism bail 101 from a latched state (as shown in FIG. 3) to an unlatched state along arrow B (as shown in FIG. 4) is enabled by the depressing of latch release button 104 in the direction of arrow H. In an embodiment, the operation of the controllable locking mechanism of the invention prevents the depressing of latch release button 104 in the direction of arrow H when the controllable locking mechanism is in the locked state, and, conversely, allows the depressing of latch release button 104 in the direction of arrow H when the locking mechanism is in the unlocked state. In the exemplary embodiment depicted, the controllable locking mechanism accomplishes this by rotation of controllable motor 300. Motor 300 is in communication with processor 800 such that it may be commanded to rotate. Motor 300 comprises a threaded shaft 109 which is threadingly engaged with locking mechanism nut 301. Locking mechanism nut 301 is in communication with a non-rotating surface such as a surface of lock housing 302 such that locking mechanism nut 301 is prevented from rotating when threaded shaft 109 of motor 300 rotates as commanded by controller 800, causing translation of threaded shaft 109 in the direction of arrow E, or against the direction of arrow E, depending upon the direction of rotation of threaded shaft 109 as commanded by the controller. When it is desired to place the smart holster into a locked state such that latch release button 104 cannot be depressed and therefore preventing latching mechanism bail 101 from transitioning from a latched state to an unlatched state, controller 800 commands motor 300 to rotate, which causes the translation of locking mechanism nut 301 in the direction of arrow E until it in a position to prevent the depressing of latch release button 104. This is the locked state. When it is desired to place the smart holster into an unlocked state such that latch release button 104 may be depressed which allows latching mechanism bail 101 to transition from a latched state to an unlatched state, controller 800 commands motor 300 to rotate, which causes the translation of locking mechanism nut 301 in the opposite direction of arrow E until it allows the depressing of latch release button 104. This is the unlocked state. Thus the controllable locking mechanism is in communication with controller 800 and is able to be commanded into a locked or an unlocked state by controller 800. Switch 110, which is in communication with controller 800 and may be a momentary switch, operates as a latch release button sensor and is adapted to signal to controller 800 that latch release button 104 has been depressed, allowing controller 800 to differentiate between "long" press of latch release button 104 and a "short" press of latch release button 104, and to signal when the smart holster has been unlatched. Other switches, for example located on lock housing 302, are in communication with controller 800 and operate as a locking mechanism sensor (shown schematically as item 823 in FIG. 8) to indicate whether the smart weapon is in the locked or unlocked state, or operate as a latching mechanism sensor 816 (depicted schematically in FIG. 8) to indicate whether the latch is latched or unlatched.

Referring now to FIG. 8, an electrical block diagram of an exemplary embodiment of the smart holster of the invention is depicted. Controller 800 may be in electrical communication with each of the other electrical components of the smart holster of the invention as depicted in the diagram. Controller 800 may also be in electrical communication with non-transitory computer readable media 810. Non-transitory computer readable and executable instructions in the form of software, firmware, or other known forms of computer readable instructions capable of performing the functions described herein may be stored in a non-transitory fashion in non-transitory computer readable media 810. Controller 800 may access non transitory computer readable media 810 for the purpose of retrieving computer readable instructions stored thereon and executing said computer readable instructions so as to carry out the functions of the invention described herein. Controller 800 may also be in electrical communication with environmental sensor devices such as one or more accelerometers 801 and temperature reading devices and other environmental sensors as may be known in the art. In this manner controller 800 may retrieve or otherwise receive information from one or more accelerometers 801 one or other environmental sensors in the form of sensor signals, and may use the data from the sensor signals to perform the functions of the invention by executing computer readable instructions it has retrieved from non-transitory computer readable media 810.

Still referring to FIG. 8, controller 800 may also be in communication with an input port 42 comprising one or more pushbuttons or keypad for receiving inputs from a user. This input port 42 may comprise input port push buttons 201, 202, 203 and 204 as depicted in FIGS. 1 and 3. However, input port 42 may comprise any user interface elements such as, for example, buttons or switches located on any surface of the smart holster. Controller 800 may also be in electrical communication with a real-time clock or other internal timing device 805, and controller 800 may also be in electrical communication with interface devices such as radiofrequency or optical wireless transceiver 806 and near field communication transceiver 803. Near field communication transceiver 803 may also be in electrical communication with a near field communication antenna 804. Wireless transceiver 806 may also be any wireless transceiver known in the art and may be in electrical communication with a radio frequency (RF) antenna or optical transceiver 821 as depicted in the diagram. Wireless transceiver 806 may be one or more transceivers comprising one or more communication ports, and may be comprised of any radiofrequency or optical wireless transceiver known in the art for communicating data to and from a remote system such as, by way of example and not by way of limitation, any digital or analog radio communication transceiver, any optical communication transceiver such as infrared and other optical communication transceivers, radio frequency transceivers designed to operate on the standard known as Wi-Fi, Bluetooth, or any other known radiofrequency data communication physical layer and protocol, cellular-based RF communication transceiver such as GSM or other transceivers capable of communicating with a cellular-based RF communications network as is known in the art, and any other radiofrequency or optical transceiver known in the art, in any combination. It is reasonably anticipated that emerging wireless communication systems may replace those listed in this description and it is within the disclosure and claim of invention that future developed wireless communication systems are included within the scope of the wireless transceiver, which may comprise a plurality of transceivers, of the smart holster of the invention. Controller 800 may also be in electrical communication with a data port 815 for programming non transitory computer readable media 810, commanding controller 800, reading information from non-transitory computer readable media 810 or the like. Data port 815 may be any electrical data communication port, and may be serial or parallel, but is preferably a Universal Serial Bus (USB) data port.

Still referring to FIG. 8, the remote user data interface of a smart holster of the invention may comprise any one or any combination of radiofrequency or optical wireless transceiver 806, near field communication (NFC) transceiver 803, and data port 815, in any number. Controller 800 may also be in electrical communication with a geolocation receiver 802, which may be a Global Position System (GPS) receiver, capable of receiving geo-locating signals from, for example, remote transmitters such as, but not limited to, GPS or other geo-positioning satellites, processing said geo-locating signals, and transmitting a signal comprising geolocation containing geolocation or time information, or both, for processing or retransmission to a remote monitoring station by controller 800 executing non-transitory computer executable instructions stored in computer readable media 810 autonomously or when commanded by a remote user through wireless transceiver 806 or data port 815.

Still referring to FIG. 8, any of the wireless or wired interface ports of the invention may operate as communication port. Thus, for example, transceiver 806, electrical port 815, and NFC transceiver 803 may all act as a communication port. Furthermore, these communication ports may present in any number. Thus there may be a plurality of transceivers 806 in communication with controller 800 for supporting various communication protocols including WiFi, Bluetooth, cellular data and SMS communication, and the like.

Still referring to FIG. 8, controller 800 may also be in electrical communication with a locking mechanism driver circuit 819 which is in electrical communication with the locking mechanism solenoid, server motor or stepper motor, 300 (depicted in FIGS. 6 and 7), for the purpose of receiving commands from controller 800 commanding motor 300 to dispose the locking mechanism of the invention in a locked state or unlocked state. Locking mechanism 300 is controllable and may be commanded as described elsewhere herein upon command from controller 800. Thus, as an example, if a remote user desires to lock or unlock the smart holster of the invention from a remote location, a command may be transmitted from the remote user by wireless means, for instance RF communication means such as GSM cellular transmission, which is received by the RF antenna of the invention. The wireless antenna is in electrical communication with wireless transceiver 806 which receives the signal transmitted from the remote user and received by the RF antenna, whereupon the received signal may be communicated to controller 800. Controller 800 may then interpret the signal sent by the remote user by the execution of computer readable instructions as read from non-transitory computer readable media 810, were upon controller 800 may command motor driver 819 to operate electromechanical latch 621 to motivate the locking mechanism of the invention into a locked, or unlocked, position as commanded by the remote user. In this manner a remote user may command the smart holster of the invention into a locked state or an unlocked state. This is an example of the use of the communication port 806.

Still referring to FIG. 8, controller 800 may be in direct or indirect communication with speaker 820. An audio amplifier may be in electrical communication with, and in line between, controller 800 and speaker 820 for the purpose of amplifying the audio signal or converting a digital signal to an analog audio signal for the purpose of driving speaker 820. In this manner, controller 800 may, upon execution of computer readable instructions stored in non-transitory computer readable media 810, cause certain sounds or audible signals to be emitted from speaker 820 as may be desired by the user and as described herein in the description of the functions of the electronic embodiment of the invention. In this manner alarm beeps or other audible signals may be utilized to indicate that the smart holster of the invention has been commanded into a locked state, an unlocked state, or any other state. Likewise, controller 800 may command an audio signal upon the activation of a remote sensor such as a camera or microphone, or may be utilized to provide specific audio command or information as commanded by a remote monitoring station in which specific audio signals have specific meaning. Also in this manner, an audible alarm may be sounded if the accelerometer 801 senses that the smart holster of the invention has been moved, or if the optional geolocation receiver 802 receives GPS information indicating that the smart holster of the invention has been moved to a new geographic location outside limits set by the user. This use of GPS location information to trigger an alarm may be termed "geo-fencing". A user may predetermine certain geographic limitations such that an alarm is sounded or an alarm signal is transmitted to a remote user through the wireless transceiver interface if the smart holster of the invention has been moved outside, or moved into, predetermined geographic areas.

Still referring to FIG. 8, controller 800 may be directly or indirectly in electrical communication with several manual buttons (items 201, 202, 203 and 204 in FIGS. 1 and 3) comprising input port 42 for the purpose of allowing a user to interface with controller 800 in order to command the smart holster to perform certain functions, to enter certain states, or to enter personal identification information such as a Personal Identification Number (PIN) or other identifying indicia. For example, one or more buttons of input port 42 may be utilized to command the smart holster into a powered on or powered off condition; to request status of the smart holster, such as for example, status of the battery charge of the smart holster; or to provide and unlock commands to controller 800.

Still referring to FIG. 8, an exterior surface of the smart holster of the invention may also comprise lighting elements of any color, or that may be commanded to illuminate in one of a variety of colors that may be red, green, blue, yellow, orange or other colors as desired by a user, that are in electrical communication with controller 800 such that controller 800 is capable of commanding the lighting elements to individually be in an on state, an off state, a blinking state, or any other state, so as to provide visual indication of the status of the invention to a user. For example, controller 800 may be in electrical communication with lighting elements such as communication status lighting element 811, power status lighting element 812, or lock status lighting element 813 or any combination thereof. The lighting elements of the smart holster are preferably, but not necessarily, light emitting diodes (LEDs), and may each have the capability to illuminate one color selected from a number of colors such as red, green, blue, yellow, orange, white or other colors, as commanded by controller 800 executing non-transitory computer readable instructions, and wherein specific lighting elements may be commanded to illuminate specific colors in certain situations, as commended by controller 800.

Still referring to FIG. 8, controller 800 may also be in electrical communication with at least one sensor for sensing the status of smart holster. In an embodiment, the at least one sensor may comprise a plurality of sensors, such as, for example, latching mechanism sensor 816 which produces a signal containing information indicating whether the latch of the invention is in an unlatched state or latched state, locking mechanism sensor 823 which produces a signal containing information indicating whether the smart holster is in a locked or unlocked state, and clip sense circuit 807, all of which may be in electrical communication with controller 800. The status of the buttons making up input port 42 may be stored in media 810.

Still referring to FIG. 8, battery 606 may be charged through an electrical port providing electrical connectivity to a battery charging source, the port being located on, in or through an exterior surface of the invention, and which may be USB port 815. Battery 606 may be in electrical communication with battery charger and power conditioning circuit 808, and may provide power to all the electrical and electronic components of the smart holster directly, or through battery charger and power conditioning circuit 808.

Still referring to FIG. 8, controller 800 may be any electrical device or combination of electrical devices capable of executing computer readable instructions such as a controller, processor, microcontroller, microprocessor, programmable logic array, embedded firmware, virtual machine, combinational logic or any other electrical or electronic device or any combination of devices known in the electrical arts as capable of executing computer readable instructions.

Still referring to FIG. 8, controller 800 may command the locking mechanism to a locked or unlocked state when user commands are received through wireless interface 806 or wired interface 606, or through input port 42 by executing non-transitory computer readable and executable instructions stored in computer readable media 810 to command the locking mechanism to a locked or unlocked state.

Still referring to FIG. 8, the invention may comprise at least one RFID tag interface 821 which may be an electrical communication with the controller. The transceivers of the invention may also be in communication with antennas, or in the case of the optical transceiver light emitting diodes, PIN diodes, or other receivers and transmitters of light energy. Battery 606 may be in electrical communication with the components described herein for providing electric power to them. Battery 606 may be replaceable, rechargeable through a wired electrical port, or may be chargeable through wireless inductive charging means. The controller 800 may be any controller, microprocessor, firmware controller, or any other combination of electrical components capable of reading and executing computer readable and executable non-transitory instructions.

In an embodiment of the invention, electrical sensors such as switches may be employed in electrical communication with the controller so that electrical signals are generated and communicated to the controller indicating that a firearm has been inserted into the smart holster; the smart holster is in a locked or unlocked state, or that the smart holster is in a latched or unlatched state. When a user causes the latching mechanism to be in an unlatched state, the controller of the invention may execute computer readable instructions causing an optical or radiofrequency signal to be generated and transmitted to a remote monitoring station via, for example, Bluetooth, Wi-Fi, cellular networks or other radiofrequency communication. Furthermore, when a user withdraws a firearm from the holster, a sensor may provide a signal to the controller indicating that the weapon has been withdrawn, and signal may be generated by the controller and transmitted to a camera in proximity to the user, triggering the camera to begin recording video data, transmitting video data to a remote monitoring station or to begin taking a series of still images. The video data or still images may be transmitted to a remote monitoring station by the smart holster through a communication port.

Likewise, the controller of the invention may be utilized to transmit geolocation information received from GPS satellite signals, cellular towers, or other RF or optical means, to a remote monitoring station. In this use, it is possible for a remote monitoring station to ascertain geolocation information regarding the smart holster by communicating with the smart holster through a wireless world wide web interface.

In yet a further embodiment, the smart holster may comprise accelerometers in electrical communication with the controller that are used to produce signals when the smart holster is moved. The signals may be used as inputs by the controller, which then executes computer readable instructions to transmit a signal to a remote user indicating that the smart holster has been moved.

In yet a further embodiment of the invention, the smart holster may comprise temperature sensors in electrical communication with the controller that are used to produce signals communicating the temperature of the interior enclosed volume of the smart holster. The signals may be used as inputs by the controller, which then executes non transitory computer readable instructions to transmit a signal to a remote user by any of the means described herein, indicating that a predetermined temperature limit has been exceeded, or providing the temperature within the enclosed interior volume of the smart holster.

In yet a further embodiment of the invention the smart holster may comprise a locking mechanism preventing the smart holster from entering an unlatched state. The locking mechanism may be in electrical communication with the controller. The controller may execute instructions for operating the locking mechanism. A user may transmit signals wirelessly to the smart holster by optical or radiofrequency ("RF") means, which signals are received by the optical and/or radiofrequency receivers comprising the invention. These signals may be utilized as inputs by the controller for commanding the locking mechanism into a locked or unlocked state. The invention may therefore be remotely locked or unlocked. A typical use scenario for this feature occurs when the user has stored a firearm in a smart holster as hereinbefore described for instance, for transporting firearms in a vehicle. If, for example, the user exits the vehicle leaving the smart holster in the vehicle, the user may utilize a mobile device, tablet, cell phone, personal computer or other electronic device to remotely communicate with the smart holster to command the smart holster to remain in a locked condition, safely securing the firearm within the vehicle and preventing unauthorized access. The smart holster may be remotely locked or unlocked in this matter, enabling a multitude of use scenarios in which a firearm may be placed in the smart holster and securely locked remotely, preventing unauthorized access.

Figure 9:
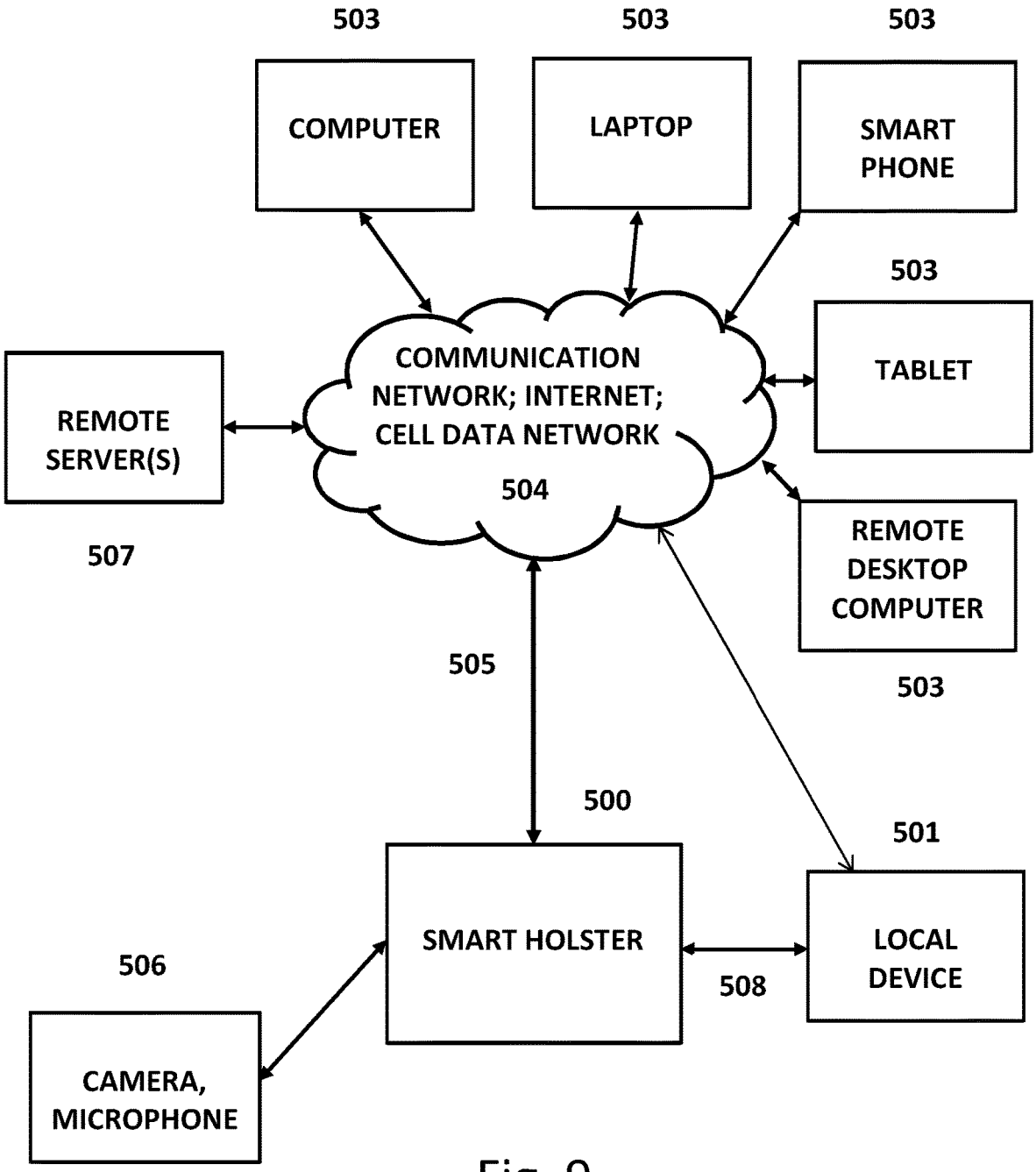
FIG. 9 depicts an exemplary system diagram of an embodiment of a smart holster of the invention in wireless communication with a remote server, a remote user device such as a computer, laptop, cell phone, smartphone, tablet, remote desktop, or any other remote smart or computing device running smart holster application software; and also showing the smart holster of the invention and wireless or wired communication with a local device which may be a computer, laptop, cell phone, smartphone, tablet, key fob or any other smart computing device. The figure also depicts the wireless connection to a key fob.

Referring now to FIG. 9, a smart holster of the invention 500 may be in wireless or wired communication 505 with a local and/or remote computing device 501 and/or 503, respectively, as described herein. The smart holster 500 may be in communication with one or more local devices 501, which may be any electronic device, such as a key fob, smart phone, tablet, computer, or other device capable of running smart holster application software and storing user authentication indicia. The smart holster may be in communication with the local device 501 wirelessly through any known wireless communication link 111, including but not limited to Wi-Fi, Bluetooth, RFID, NFC, or any RF communication link, or infrared optical communication links. The smart holster may also be in wired communication with one or more local devices 501 via a USB port or any other electrical connection. The local device 501 may comprise a controller for executing instructions in communication with a transceiver for communicating with controller 800 of a smart holster of the invention, and may comprise non-volatile computer readable instructions in non-volatile computer readable media for storing instructions such that the local device processor may execute smart holster application software to communicate with smart holster 500 and to command smart holster 500 to carry out the functions described herein. Likewise, smart holster 500 may also be in communication with one or more remote devices 503 which may be any number or combination of computers, smart phones, tablet computers, laptop computers, desktop computers, smart phones or any other device capable of running and executing smart holster application software and storing user authentication indicia. Such devices may be used as remote monitors and thus may comprise a remote monitoring station. Communication between the smart holster 500 and the remote devices 503 may be wired or wireless through the remote user data interface. In the case of wireless communication the remote devices 503 and smart holster 500 may communicate via GSM, CDMA or other cellular radio based communication links, RF analog radio data links, the Internet, IEEE 802.11 wireless LAN, other wireless LANS or any other communication network, and in any combination thereof. In this manner the smart holster of the invention 500 may be controlled, monitored or tracked geographically remotely by the remote monitoring station as described herein, and a remote monitoring station may command the smart holster 500 into locked or unlocked states, may receive alerts and alarm information as described herein and may receive other status information as desired by the remote user. The smart holster 500 may also be in wireless communication with a remote server 507 via the world wide web 504 as shown in the figure. In a preferred embodiment all smart holster configuration information, status inquiries, and notifications may be communicated via the world wide web 504 to a remote server 507, where it may be made available to a user via, for example, a web site or application running on a remote device such as a cell phone software application.

Figure 18:
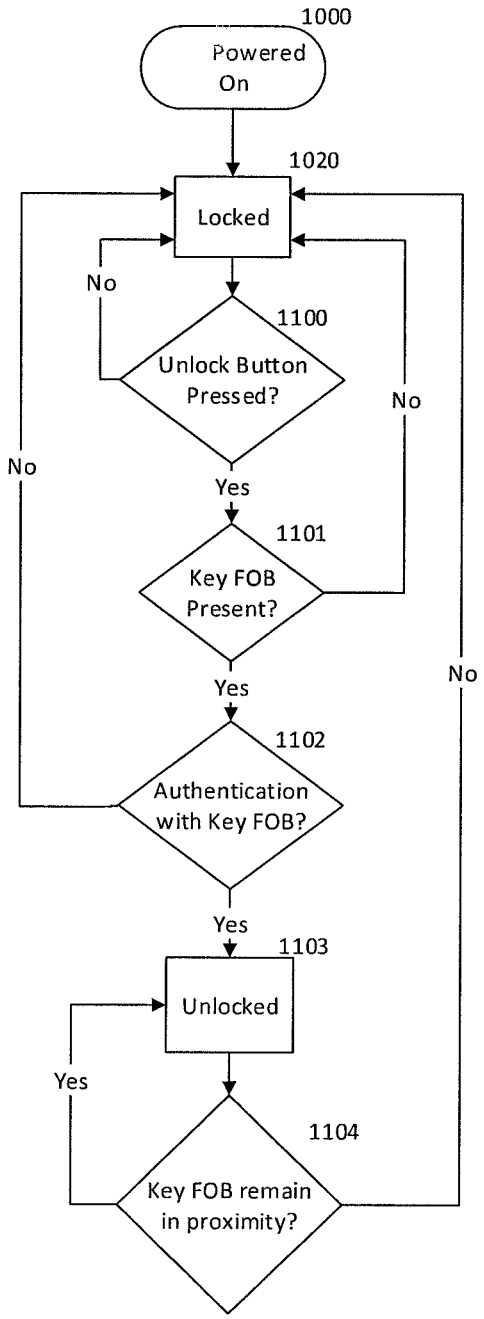
FIG. 18 depicts an exemplary flow diagram for a key fob embodiment of the invention.

Still referring to FIG. 9, in an embodiment, local device 501 may be a key fob. Such a key fob may be carried by a user, for example on a key chain or in a user's pocket. The key fob may comprise wireless communication components such as Radio Frequency Identification (RFID) components, Bluetooth or other RF, optical, or other wireless communication means as described herein. In the key fob embodiment, the smart holster 500 communicates wirelessly and preferably automatically with the key fob when the user comes into proximity of the smart holster 500 such that the locking mechanism is commanded by the controller 800 to lock the smart holster 500 when the key fob is not in proximity to smart holster 500, and to unlock smart holster 500 when the key fob is in proximity to smart holster 500. "Proximity" may be any distance desired by a user and within the communication capability of the wireless communication components comprising the key fob and the smart holster. Typically, in a key fob embodiment utilizing RF components in both the key fob and the smart holster in wireless communication, the operational distance may be predetermined by selecting the type of RF communication link, such as for example RFID; selection of either passive or active RFID tags within the key fob; type of antennas employed; receiver sensitivity; transmit power and operating frequency. These components may be selected, for example, to provide communication when the key fob is within three feet, five feet, ten feet, twenty feet or greater. The user may be presented with a means for programming the transmit power, for example by inputting data into input port 42 or through port 815 (ports 42 and 815 are not shown in FIG. 9 bur are depicted in FIG. 8) or any communication port, such that a desired operating distance is achieved. For an example in which smart holster 500 is to be carried on a person such as a personal holster, the operating distance may be on the order of one foot or less. In an example in which smart holster 500 is carried in a vehicle, for example between a front seat and vehicle console, a user may desire that smart holster 500 be unlocked automatically via key fob communication when the key fob is within close proximity to the vehicle, for example an operating distance of ten feet or less. The key fob may comprise a switch for enabling or disabling communication with smart holster 500. A flow diagram for a key fob embodiment of the invention is depicted in FIG. 18, described below.

Still referring to FIG. 9, the smart holster 500 may comprise application software, which may include non-volatile computer readable instructions, and which may be downloaded to a local device 501 or a remote computing device 503 from a remote server 507 through, for example the world wide web 504, from online application stores, or from or through any other source, and may reside in a local electronic device 501 non transitory computer readable media. The smart holster application software may be operable to provide a user interface for the entering and the transmitting of commands to a smart holster of the invention 500 via a remote user data interface and may contain instructions allowing a user to establish, store and execute schedules for events such as scheduling locking and unlocking of the smart holster, GPS tracking and geolocation information storage including location history, monitoring smart holster battery status, and the like. The smart holster application software may comprise instructions for carrying out the methods and steps described and taught herein. Devices 501 and 503 may be termed remote electronic devices in that they do comprise a part of smart holster 500; i.e., they are "remote" from smart holster 500.

Still referring to FIG. 9, the smart holster 500 may further comprise an external camera or audio recording or transmitting device 115, such as a body camera, in wireless or wired communication with the transceiver 806. When the latching mechanism sensor 816, which is in electrical communication with controller 800, determines that the latching mechanism has been retracted into an unlatched state, the controller 800 may execute non-transitory computer executable instructions to command camera or audio recording or transmitting devices 115 to an on state, and may causes video or audio signals, or both, to be transmitted to a remote monitoring station, or to be stored in memory 810 (shown in FIG. 8), or both. In this manner, local video or audio information, or both, may be automatically recorded or transmitted to a remote monitoring station when the latching mechanism is in an unlatched state, enabling a firearm or other valuable item for immediate use.

In the flowcharts of FIGS. 10-18, the term "open" has the same meaning as "unlatched", and the term "closed" has the same meaning as "latched".

Figure 10:
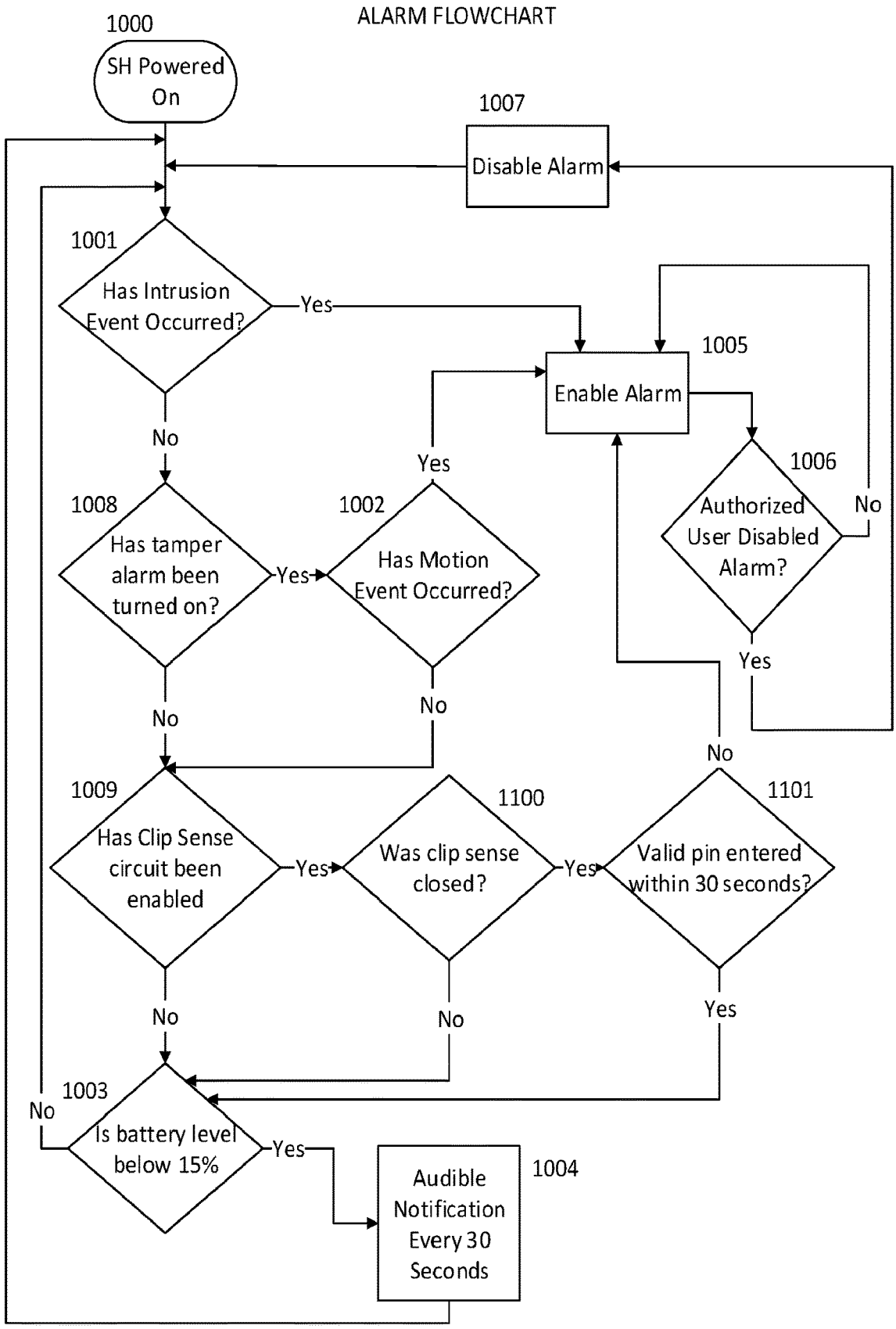
FIG. 10 depicts an exemplary flow diagram of one embodiment of an alarm function of an electronic embodiment of the smart holster of the invention.

Referring now to FIG. 10, a flow diagram of one embodiment of an alarm function of an electronic embodiment of the smart holster of the invention is depicted. In a first step 1000, the smart holster of the invention may be in an ON state, or may be placed into a powered-on condition by operation of a manual pushbutton forming part of input port 42 (depicted in FIG. 8). Once having powered on, controller 800 may monitor the state of sensors placed within the smart holster to determine whether an intrusion event, such as, for example, unauthorized unlatching of the smart holster which may be defined as unlatching of the smart holster without a proper PIN code having been received, has occurred in step 1001. If it is determined that an intrusion event has occurred an alarm may be operated, step 1005. The alarm may be an audible alarm such as playing a sound through speaker 820 (depicted in FIG. 8), a visible alarm in the form of lighting lights such as LED lights 811-813 (depicted in FIG. 8) which may be placed on any surface of the smart holster of the invention, the transmission of a signal to a remote monitoring station through the remote user data interface of the smart holster, or any combination of these alarms. The transmission of a signal containing alarm information to a remote user through the remote user data interface may be in the form of a cellular text message sent to a predetermined cellular telephone number or other entity capable of receiving a cellular text message, or may be message transmitted to a remote monitoring station. Once the alarm has been operated in step 1005, the smart holster monitors whether the alarm has been disabled 1005. An authorized user may disable the alarm 1007 by entering a PIN code on input port 42, causing the smart holster of the invention to be placed into a no-alarm state, whereupon it will return to monitoring whether an intrusion has occurred 1001. If an authorized user has not disabled the alarm, the alarm will continue to operate.

Still referring to FIG. 10, if no intrusion event has occurred 1001, the smart holster of the invention senses whether the tamper alarm has been turned on, step 1008. The tamper alarm may be turned on remotely by receiving signals through wireless interface 806 (depicted in FIG. 8) or may be set by a user by manual operation of pushbuttons forming input port 42. If the tamper alarm has been turned on 1008, the smart holster may interrogate or receive signals from the one or more accelerometers of the invention 801 (depicted in FIG. 8). If the one or more accelerometer signals indicate that a motion event has occurred 1002, such as the at least one accelerometers sensing that the smart holster has been rotated beyond a predetermined limit, or the accelerometers sensing that the smart holster has been moved continuously for programmable minimum period of time such as, for example, five seconds, the alarm of the invention may be enabled 1005 and will remain enabled until an authorized user disables the alarm as above described.

Still referring to FIG. 10, if the tamper alarm has not been turned on 1008, or, if it has been turned on but no motion event has occurred 1002, the smart holster of the invention senses whether fast access mode has been enabled 1009. Controller 800 may read the state of registers in non-transitory computer readable media 810 in order to determine whether fast access mode, in which the lock is in an unlocked state and the smart holster has been clipped onto a structure such that the clip sense circuit is open, has been commanded by a user operating pushbuttons 42 and entering, for example, a PIN code and command, or by a remote user transmitting wireless signals to the smart holster through the remote user data interface. If fast access mode has been enabled 1009, the smart holster may sense whether the clip circuit is closed, indicating that the smart holster has not been placed on a structure such as, for example, the pants belt of a user. If the clip circuit has not been closed 1100, indicating that the smart holster is located on a receiving structure such as the pants belt of a user, controller 800 may execute a timer for a predetermined programmable period of time 1101, which may be, for example, thirty seconds, and if a valid PIN code is not entered into the smart holster through pushbuttons 42 prior to the expiration of the predetermined programmable period of time, alarm 1005 may be operated and may be disabled as above described.

Still referring to FIG. 10, if fast access mode has not been enabled, the level of charge of battery 606 is ascertained by controller 800 reading signals from the battery charger and power conditioning circuit 808 (depicted in FIG. 8) to determine if the battery charge level is below a predetermined low-charge threshold, such as, for example, 15% of full charge. If the battery level is below a predetermined low-charge threshold an audible notification will be commanded by controller 800 through speaker 820 (depicted in FIG. 8), for example an audible signal made every 30 seconds such as a beep, until the battery level is returned to a level that is greater than a predetermined low-charge threshold as determined by battery charger and power conditioning circuit 808. A predetermined low-charge threshold and a pre-determined medium-charge threshold may each be stored in non-transitory computer readable media 810 and may therefore be readable by controller 800.

Figure 11:
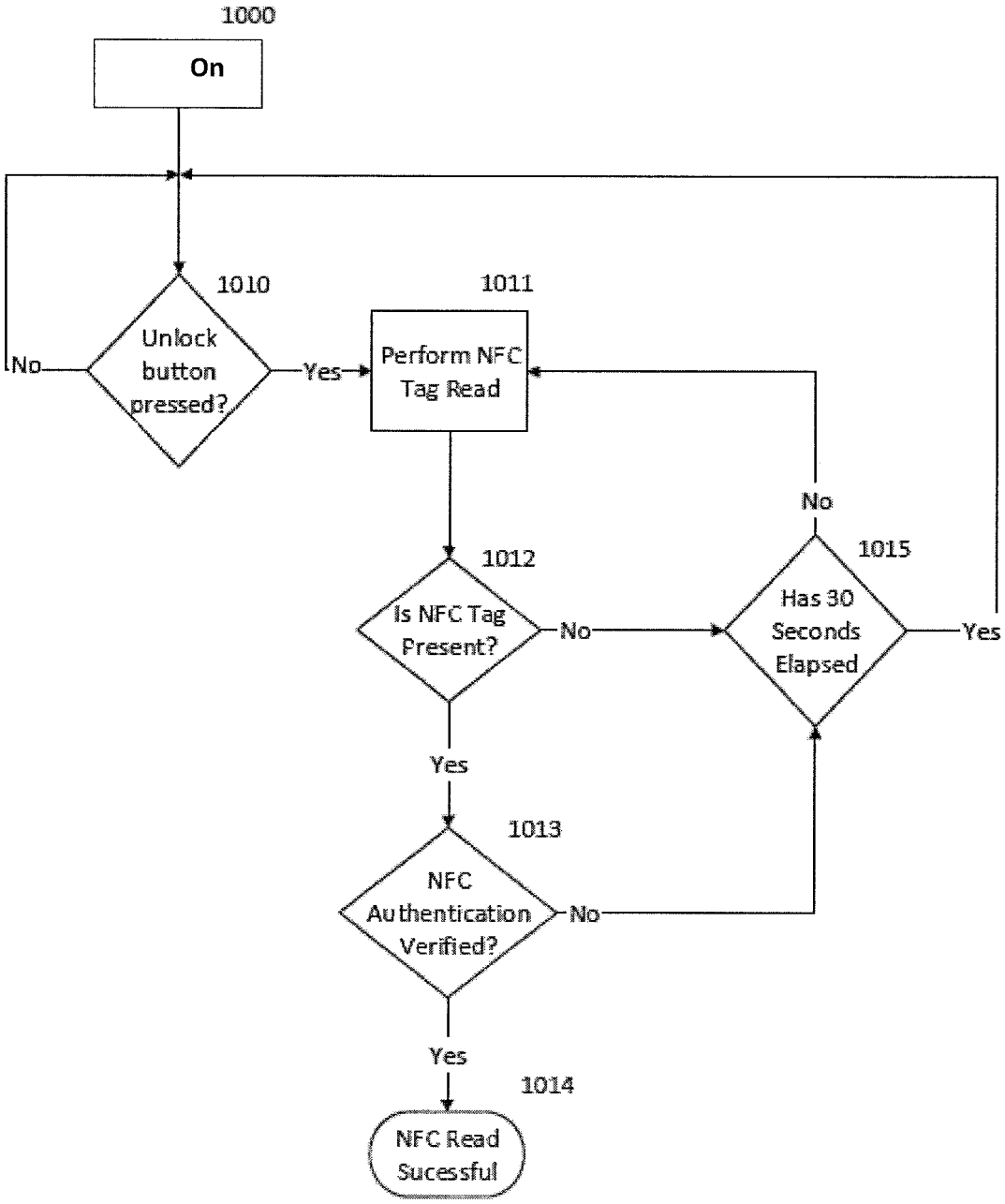
FIG. 11 depicts an exemplary flow diagram of one embodiment of a Near Field Communication (NFC) read function of an electronic embodiment of the smart holster of the invention.

Referring now to FIG. 11, a flow diagram of an embodiment of the smart holster of the invention which utilizes an optional Near Field Communication (NFC) read function of an electronic embodiment of the smart holster of the invention is described. In a first step 1000, the smart holster of the invention may be placed into a powered-on condition as above described. Once having powered on, controller 800 or other circuitry may monitor the state of a push button of input port 42 (depicted in FIG. 8) to determine whether a user has commanded the smart holster to unlock, step 1010. If a user has commanded unlock through input port 42, the controller 800 monitors a near field communication transceiver in communication with controller 800 in order to ascertain whether a near field communication tag has been read 1011. If it is determined that a near field communication tag is present 1012, controller 800 executes computer readable instructions to determine whether the near field communication tag is an authenticated tag of an authorized user, step 1013. An authenticated near field communication tag is one that has been predetermined as belonging to an authorized user of the smart holster of the invention, and for which a code has been stored in non-transitory computer readable media 810. If it is determined by controller 800 reading non transitory computer readable media 810 and executing computer readable instructions that the near field communications tag is that of an authorized user, the controller generates and stores in non-transitory computer readable media 810 a near field communication read successful message 1014. If it is determined by controller 800 executing computer readable instructions that near field communications tag is not that of an authorized user 1013, it determines whether a predetermined, programmable period of time, such as 30 seconds, has elapsed since the near field communication tag read by the near field communication transceiver in step 1015. If the predetermined, programmable period of time has not elapsed, controller 800 returns to step 1011 and performs another near field communication tag read. If the predetermined, programmable period of time has elapsed, controller 800 commands the smart holster of the invention to return to a state wherein it reads whether a push button of button array 42 has been pressed to command unlock, step 1010.

Figure 12:
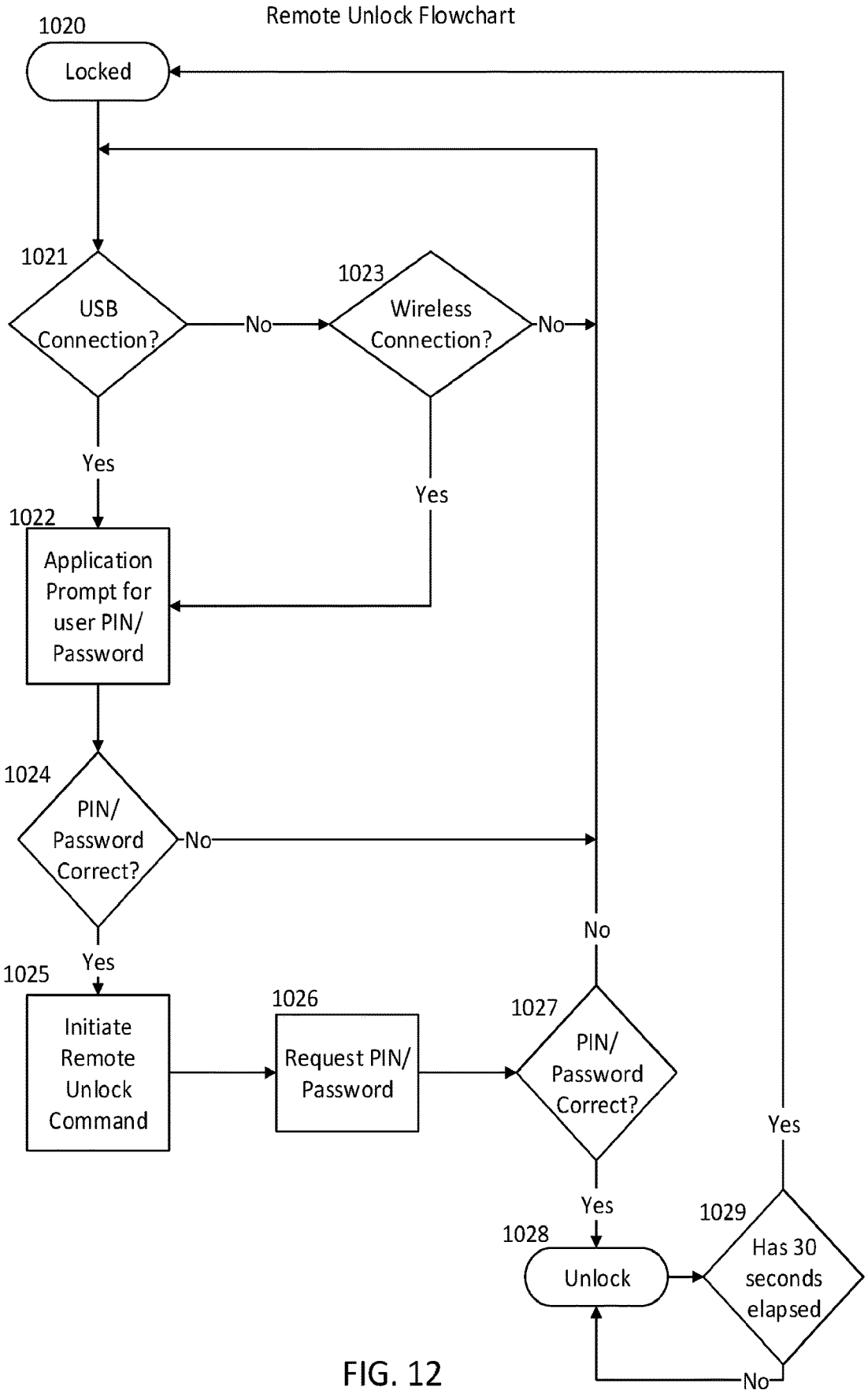
FIG. 12 depicts an exemplary flow diagram of one embodiment of a remote unlock function of an electronic embodiment of the smart holster of the invention.

Referring now to FIG. 12, a flow diagram of one embodiment of a remote unlock function of an electronic embodiment of the smart holster of the invention is depicted. In an initial state 1020, the lock of the smart holster of the invention is in a locked condition. In a next step 1021, controller 800 reads the state of Universal Serial Bus (USB) port 815 (depicted in FIG. 8) to determine whether there is an active USB connection to a remote device. If there is no active USB connection to a remote device, controller 800 executes non-transitory computer readable instructions to determine in step 1023 whether there is an active wireless connection through wireless transceiver 806 (depicted in FIG. 8) to a remote device such as a laptop computer, smart phone, tablet or tablet computer, smart watch, Internet connection or other wireless connection to a remote device. If it is determined that there is an active USB connection or a wireless connection to a remote device, controller 800 may execute computer readable instructions in to communicate with the connected device and to thereby receive a remote device signal, whether the remote device is connected via USB or wirelessly, whereupon a user using the connected device may be prompted to enter a personal identification number, or PIN, password, or other identifying indicia which may be operative to identify the user and to allow controller 800 to execute instructions in order to determine whether the user is an authorized user. The user may have already provided identifying indicia such as a personal identification number (PIN), password or the like that has been stored in non-transitory computer readable media 810 to facilitate controller 800's execution of instructions to identify whether the user is an authorized user 1024. If the user is determined to be an authorized user by the entry of a correct PIN or password 1024, controller 800 will execute instructions to initiate the remote unlock command 1025 and will again require the remote user to enter a personal identification number, password, or other identifying indicia 1026. If the user again enters correct authenticating identifying indicia (i.e. for the second time) 1027, controller 800 will execute instructions commanding the locking mechanism to an unlocked state as hereinbefore described, thus placing the smart holster of the invention in an unlocked condition 1028 (in other words, the smart holster is placed into fast access mode). Requiring a user to enter authenticating identifying indicia twice is an optional safety feature that is intended to prevent accidental unlocking of the smart holster by the user. This could happen, for instance, if a user accidentally swipes an "unlock" command on their cell phone touch screen while the smart holster software application is running on the cell phone and the cell phone is in wireless communication with the smart holster of the invention through the remote user data interface. The smart holster will remain unlocked 1028 for a predetermined, programmable period of time, such as, for example, thirty seconds, and then will return to the locked condition 1029. If the identifying indicia such as personal information number or password are not correct, step 1027, the smart holster of the invention will remain in the locked condition and the process will start again 1021. Thus a remote user may remotely unlock the smart holster for a predetermined, programmable period of time, such as, for example, thirty seconds.

Figure 13:
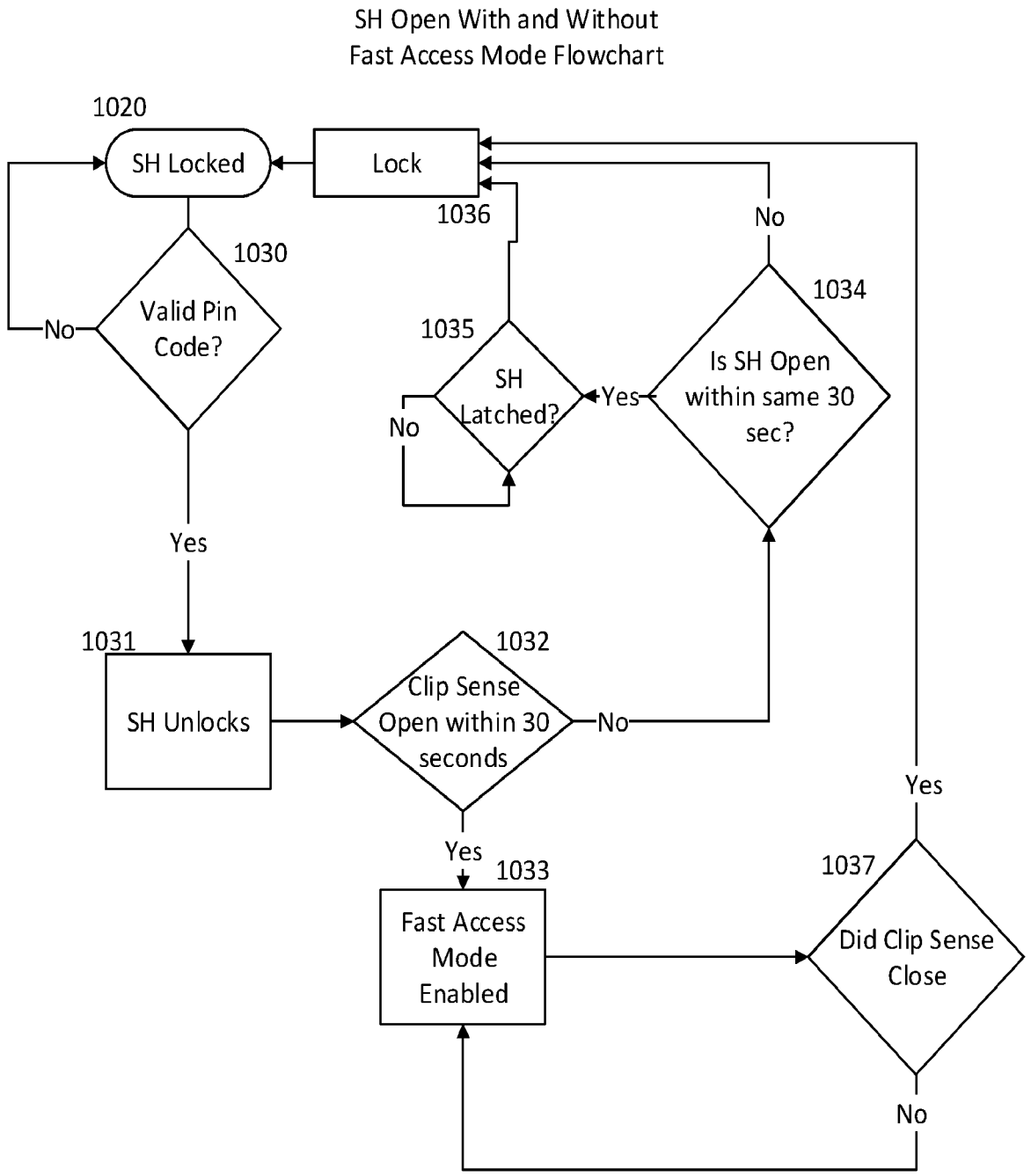
FIG. 13 depicts an exemplary flow diagram of one embodiment of an open function of an electronic embodiment of the smart holster of the invention.

Referring now to FIG. 13, a flow diagram of one embodiment of an optional "open" function of an electronic embodiment of the smart holster of the invention is depicted, in which the smart holster of the invention may be opened in either fast access mode, or non-fast access mode. In this embodiment of the open function, the smart holster may begin in a locked condition 1020. The smart holster of the invention may be unlocked by a user entering a PIN code through input port 42 (depicted in FIG. 8) in step 1030. If controller 800 determines that the PIN code is correct 1030, controller 800 may command the locking mechanism to an unlocked state, thus unlocking the smart holster 1031 so that it may be placed in an unlatched state. If controller 800 determines that the PIN code is incorrect 1030, the smart holster remains locked 1020. After step 1031, controller 800 may continue to execute non transitory computer readable instructions to determine whether the clip sense circuit has opened within a predetermined programmable time, for example thirty seconds, step 1032. If the clip circuit has opened with a predetermined programmable time, for example thirty seconds, for example by placing the smart holster onto a pants belt by engaging clip 103 onto a belt, fast access mode is enabled 1033 in which the smart holster is unlocked. Controller 800 may continue to monitor the clip sense circuit 1037. If the clip sense circuit remains open 1037, fast access mode continues to remain enabled. If, however, clip sense circuit closes 1037, controller 800 commands the locking mechanism of the invention into a locked state 1036, 1020, locking the smart holster, and the process can begin again by user entering a PIN code 1030 into input port 42.

Still referring to FIG. 13, if the clip sense circuit has not opened in a predetermined programmable time, for example thirty seconds, step 1032, controller 800 executes non transitory computer readable instructions to determine whether the smart holster has been opened with the predetermined programmable time, 1034. If it has, controller 800 executes non transitory computer readable instructions to determine whether the smart holster has been latched 1035. Once the smart holster has been latched 1035, controller 800 executes non transitory computer readable instructions to place the locking mechanism in to a locked state 1036, 1020, locking the smart holster, and the process can begin again by user entering a PIN code 1030. If the smart holster is not opened within the predetermined programmable time, 1034, controller 800 executes non transitory computer readable instructions to place the locking mechanism into a locked state 1036, and the process can begin again by user entering a PIN code 1030.

Figure 14:
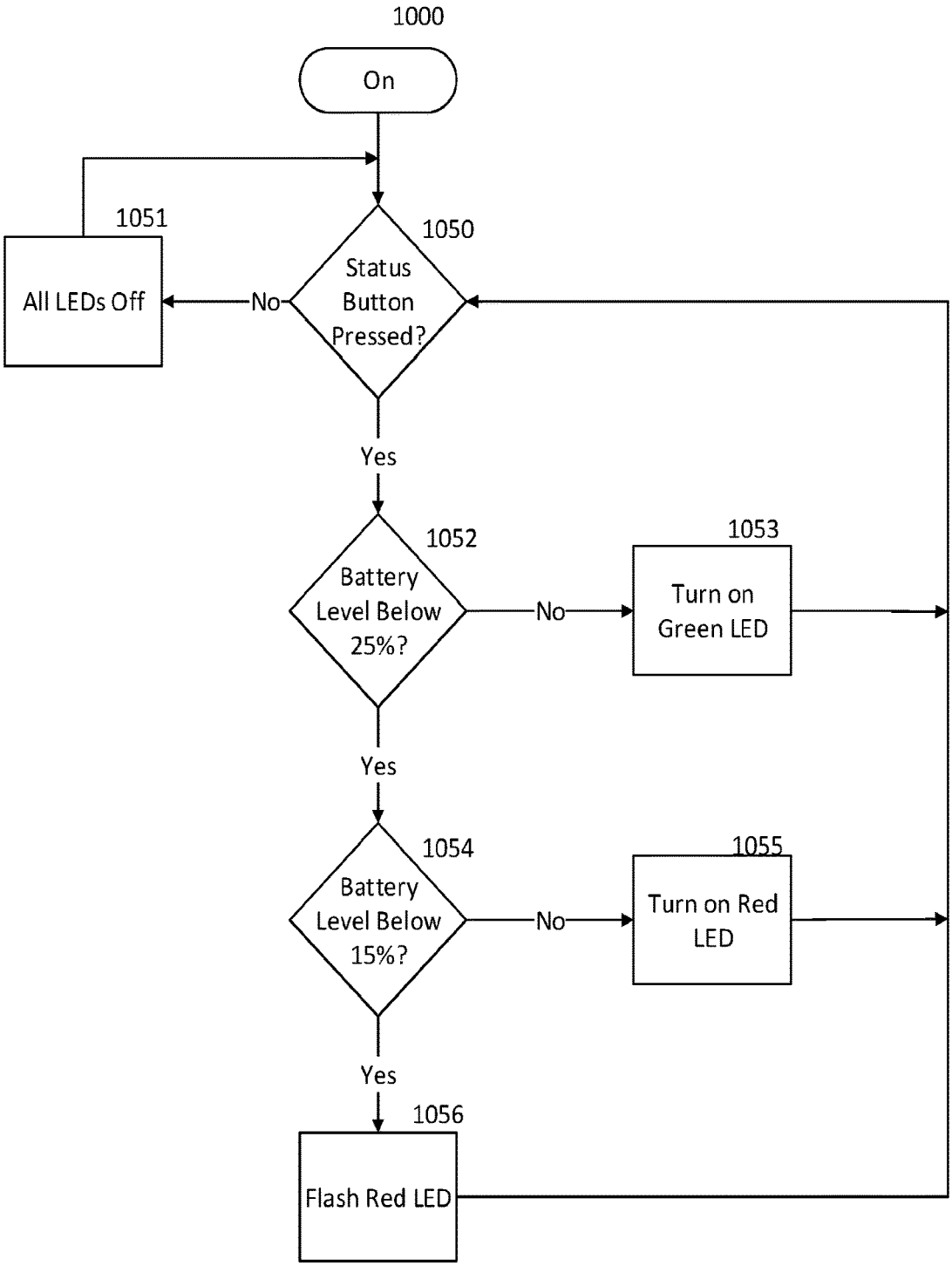
FIG. 14 depicts an exemplary flow diagram of one embodiment of a battery charge level indicator function of an electronic embodiment of the smart holster of the invention.

Referring now to FIG. 14, a flow diagram of one embodiment of a battery charge indicator function of an electronic embodiment of the smart holster of the invention is depicted. In an initial step 1000, the smart holster of the invention is powered on. Controller 800 may execute computer readable instructions to make a determination whether a status button, which may be, for example a button of input port 42, has been pressed by a user. If a status button has not been pressed, controller 800 will execute instructions to cause power status indicator light 812 to remain in an off, non-illuminated, state in step 1051 and controller 800 will continue to monitor the state of pushbutton array 42 in order to ascertain whether a status button has been pressed. If a status button has been pressed by the user 1050, controller 800 will execute instructions to receive a signal containing battery charge level information from battery charger and power conditioning circuitry 808 and to make a determination whether the battery charge level of battery 606 is below a predetermined medium-charge threshold, for example, 25% of full charge in step 1052. If, in step 1052, it is determined by controller 800 that the battery level is below a predetermined medium-charge threshold, controller 800 will then execute instructions to make a determination as to whether the battery level is below a predetermined low-charge threshold, step 1054. If the battery level is below a predetermined low-charge threshold, controller 800 may execute instructions to illuminate a red light, such as power status indicator light 812 operating in red mode, for example to flash, in step 1055, indicating that a low battery level condition exists. If, in step 1052, it is determined that the battery level is not below a predetermined medium-charge threshold, controller 800 will execute instructions to illuminate a green light, such as power status indicator light 812 operating in green mode, in step 1053. If, in step 1054 it is determined that the battery level is below a predetermined low-charge threshold, controller 800 may execute instructions turning on a red light. The lights referred to in this series of steps regarding battery indication are preferably visible on an exterior surface of the smart holster of the invention, or may transmit light through a transparent window allowing a user to view the indicated status without needing to open the smart holster or to unlock the smart holster. In an embodiment, controller 800 will only illuminate the lighting elements of the invention if a user has depressed one or more pushbuttons of pushbutton array 42, and such illumination may be for a predetermined length of time programmable by storing a time value in computer readable media 810 which is read by controller 800 and used to determine the length of time for which it is desired that the lighting elements be illuminated, indicating status of the smart holster. In this manner the smart holster may be operated discretely because the lighting elements will only illuminate upon command by a user, and may only illuminate for a predetermined length of time.

Figure 15:
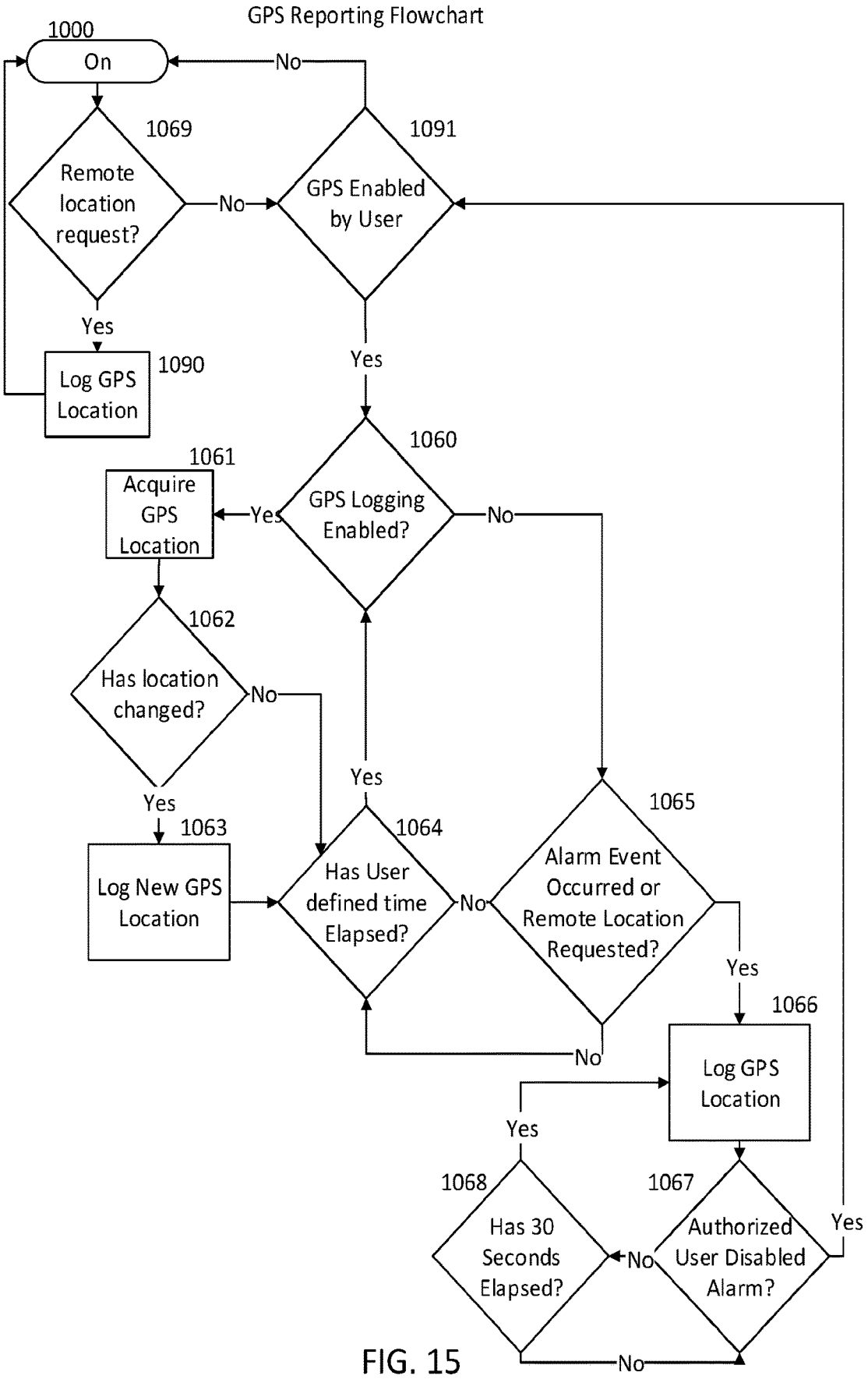
FIG. 15 depicts an exemplary flow diagram of one embodiment of a geolocation function of an electronic embodiment of the smart holster of the invention.

Referring now to FIG. 15, a flow diagram of one embodiment of a GPS geo-locating and location logging function of an electronic embodiment of the smart holster of the invention is depicted. In an initial step 1000 the smart holster of the invention is in an on condition. Controller 800 may execute instructions 1069 to determine whether a remote user has requested smart holster geolocation information 1069. If a remote user has requested geolocation information, controller 800 may execute instruction to read geolocation information from GPS receiver 802 and store the geolocation information in memory 1090 such as non-transitory computer readable media 810. If a remote user has not requested geolocation information 1069, controller 800 determines whether GPS has been enabled by a user 1091. If it has, controller 800 then may determine whether GPS logging has been enabled 1060. If GPS has not been enabled by a user 1091, controller 800 continues to monitor for a remote location request 1069.

If GPS has been enabled by a user 1091, and if GPS logging has been enabled by a user 1060, the GPS receiver 802 will acquire GPS location information 1061. If the location of the smart holster has changed 1062, for example beyond a predetermined limit, the new geolocation information is logged into non transitory computer readable media 1063. If a user defined time limit has elapsed 1064, controller 800 checks to see if GPS logging is enabled 1060 and the process repeats if it has. If GPS logging has not been enabled 1060, and if an alarm event has not occurred or if no remote location request has been received 1065, controller 800 checks to see if a user defined time limit has elapsed 1064.

Still referring to FIG. 15, if GPS logging has been enabled by a user 1060, GPS tracker transceiver 802 (depicted in FIG. 8) will acquire GPS satellite communication and will provide a signal corresponding to the geographic location of the smart holster, 1061. Controller 800 will store the location information from the signal corresponding to the geographic location of the smart holster in non-transitory computer readable non transitory computer readable media 810 and may compare the geolocation information to previously stored geolocation information in step 1062 so as to make a determination as to whether the smart holster of the invention has been moved to a new location 1063. A user may, through the wireless interface or USB interface and by using an external device such as a laptop, tablet, cell phone, smart watch or any other device running smart holster application software, program geographic limitations or boundaries into the smart holster for storage in non-transitory computer readable media 810 so that the user may define custom geographic territorial limits which would result in a notification, which could be audible, visual, or message such as email, instant message, SMS text message or the like in those instances in which the smart holster has been moved beyond a predetermined geographic limits. If the geographic location of the smart holster has changed, for example beyond a predetermined geographic limit, step 1062, the new GPS geolocation information is received by controller 800 and stored in a non-transitory computer readable media 810. If the geolocation of the smart holster has not changed, for example beyond a predetermined geographic limit, step 1062, controller 800 executes instructions to determine whether 30 minutes has elapsed since the last geolocation reading, step 1064. If 30 minutes or more has elapsed, the cycle starts again and if GPS tracking remains enabled 1060, a new GPS geolocation signal is acquired step 1061. If 30 minutes has not elapsed since the last GPS geolocation reading, step 1064, the controller 800 executes instructions to determine whether any alarm event has occurred or whether a remote user has requested geolocation information, for instance, through the RF wireless transceiver or optical transceiver 806, step 1065. If no alarm event has occurred and if no remote location request has been made by a remote user, the system continues to monitor whether 30 minutes has elapsed since the last geolocation reading. If an alarm event has occurred or if a remote user has requested location information, step 1065, GPS location information of the smart holster is received by controller 800 and stored in non-transitory computer readable media 810. Next, controller 800 executes instructions to determine whether an authorized user has disabled the alarm, step 1067 if an authorized user has not disabled the alarm, controller 800 determines whether 30 seconds has elapsed 1068. If more than 30 seconds has elapsed the system logs GPS location data in step 1066 by causing controller 800 to execute instructions storing the GPS location data in non-transitory computer readable media 810. If 30 seconds has not elapsed, controller 800 continues to monitor whether an authorized user has disabled the alarm 1067. If, in step 1067, an authorized user has disabled the alarm, the system remains in the on state and controller 800 continues to monitor whether GPS tracking has been enabled and the method returns to step 1060.

Figure 16:
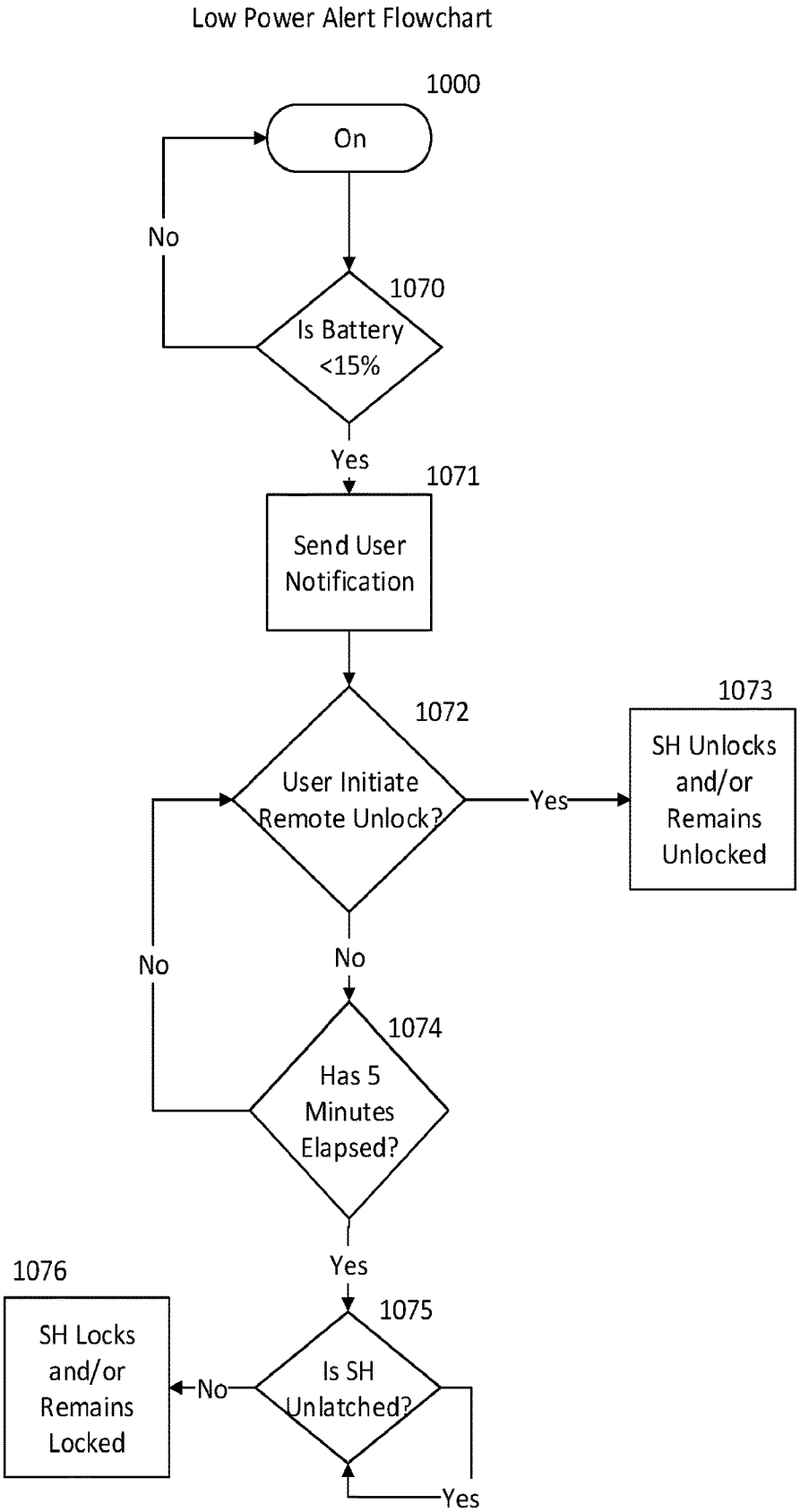
FIG. 16 depicts an exemplary flow diagram of a low battery charge level alert function of an electronic embodiment of the smart holster of the invention.

Referring now to FIG. 16, starting from a powered-on condition 1000, controller 800 will execute instructions to receive a signal from battery charger and power conditioning circuitry 808 and to make a determination whether the battery charge level of battery 606 is below a predetermined low-charge threshold, which may be for example 15% of full charge, in step 1070. If the battery charge level is below the predetermined low-charge threshold, a BATTERY CHARGE LOW or equivalent message will be transmitted to a remote user through wireless transceiver 806, step 1071. If a remote user has initiated a Remote Unlock command to the smart holster through wireless transceiver 806 or through USB interface 815 in step 1072, controller 800 will command the locking mechanism into an unlocked state and the smart holster will remain unlocked 1073. If a remote user has not initiated a Remote Unlock command 1072, controller 800 will, for a programmable period of time, for example five minutes, continue to monitor for a Remote Unlock command 1072. If, after the programmable period of time, no Remote Unlock command has been received, controller 800 will command the locking mechanism into a locked state, causing the smart holster to be in a locked condition.

Figure 17:
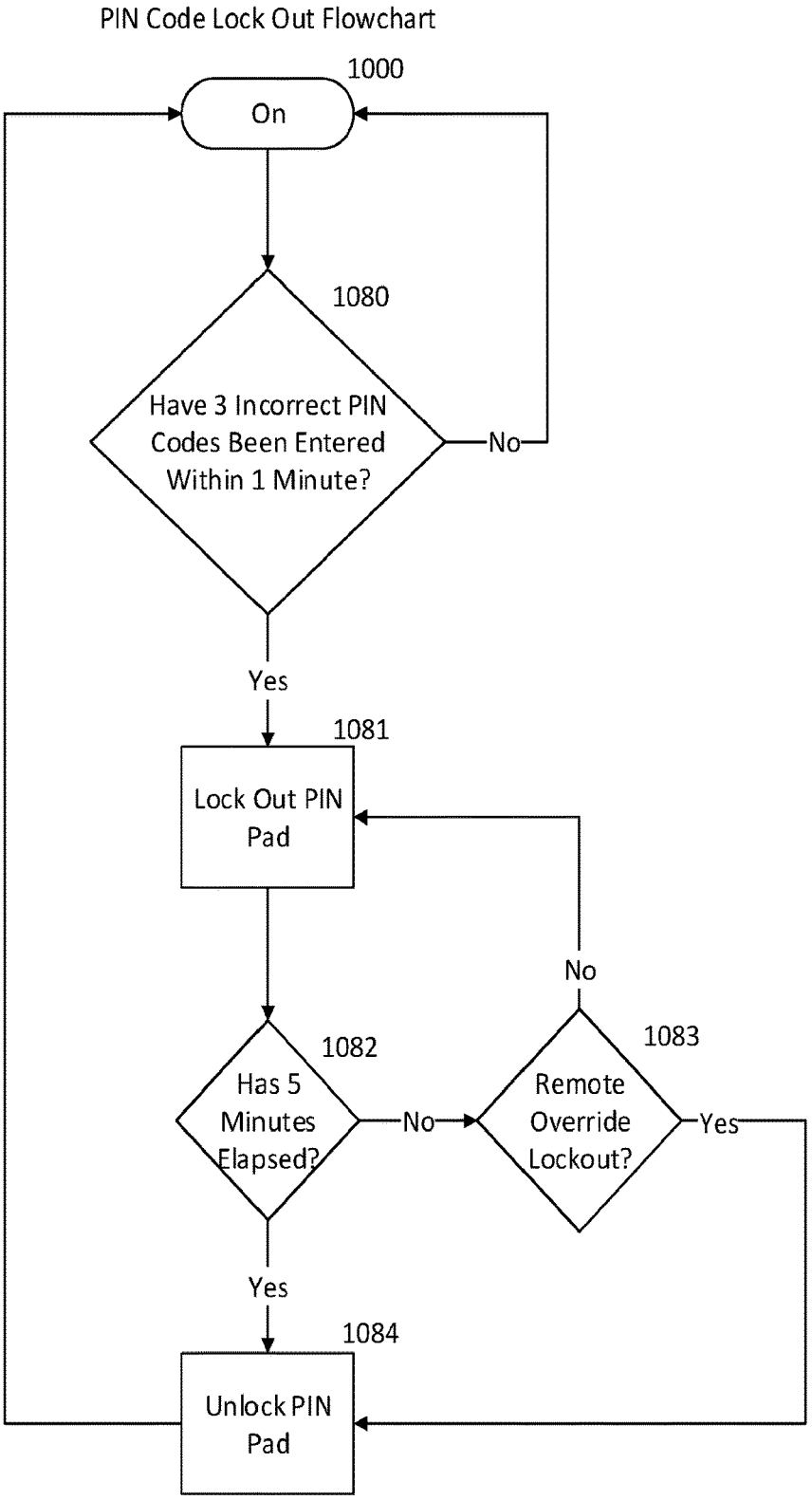
FIG. 17 depicts an exemplary flow diagram of one embodiment of a PIN code lockout function of an electronic embodiment of the smart holster of the invention.

Referring now to FIG. 17, a PIN code lockout flow diagram is presented. In an initial step the smart holster is power to an on state 1000. Once a user begins entering PIN codes into input port 42 or by any other means, controller 800 monitors to check if three incorrect PIN codes have been entered within a programmable period of time, for example one minute, step 1080. If they have, the PIN pad will be disabled 1081 and will not accept entry of PIN codes for a programmable PIN code lockout period 1082 which may be, for example, five minutes. A remote user may remotely, through wireless transceiver 806, transmit commands causing the lockout period to be terminated 1083 and unlocking, or re-enabling, PIN pad 1084 and returning the smart holster to a state in which a local user may again attempt to enter a PIN code through the PIN pad.

In any step of the invention described herein, the functions described may be carried out by controller 800 executing non-transitory computer readable and executable instructions stored in computer readable media 810. Such instructions may also be carried out by the various circuit elements that comprise electronics assembly 610 or any circuit elements connected thereto. Thus these functions are not limited to being carried out by controller 800, and the claims of the patent should be thus interpreted. The steps described are optional, and need not be present in all embodiments of the invention. They may be present in any combination.

Referring now to FIG. 18, a flow diagram for a key fob embodiment of the invention is depicted. Initially, the smart holster of the invention may be powered on in step 1000, and may persist in a locked state 1020 upon power up. The key fob may comprise a processor in communication with an RF transmitter, or may comprise an RFID tag. The key fob RF transmitter or RFID tag may be in communication with the RF transceiver of the smart holster, such that the processor 800 of the smart holster may set a register or store to non-volatile computer readable media 810 a KEY FOB PRESENT code to indicate that the key fob is present. When it is desired to unlock the smart holster, an unlock button of input port 42 on the smart holster may be depressed, step 1100. If the key fob is determined to be present as set forth above, step 1101, a code received from the key RF link or RFID tag is received by the smart holster RF receiver and compared with the authentic PIN code stored in non-volatile computer readable media 810 in step 1102. If the code is authenticated, the smart holster is unlocked by an electromechanical latch, step 1103. The processor 800 will instruct the electromechanical latch to remain in an unlocked position for as long as the key fob remains in proximity 1104. However, when the key fob is physically separated by a distance such that the RF link between the key fob and RF transceiver 806 is broken, or when the RFID tag in the key fob no longer is able to communicate with RF transceiver, the KEY FOB PRESENT code set by controller 800 is changed by controller 800 to indicate that the key fob is no longer present, and controller 800 commands the locking mechanism to a locked state.

Figure 19:
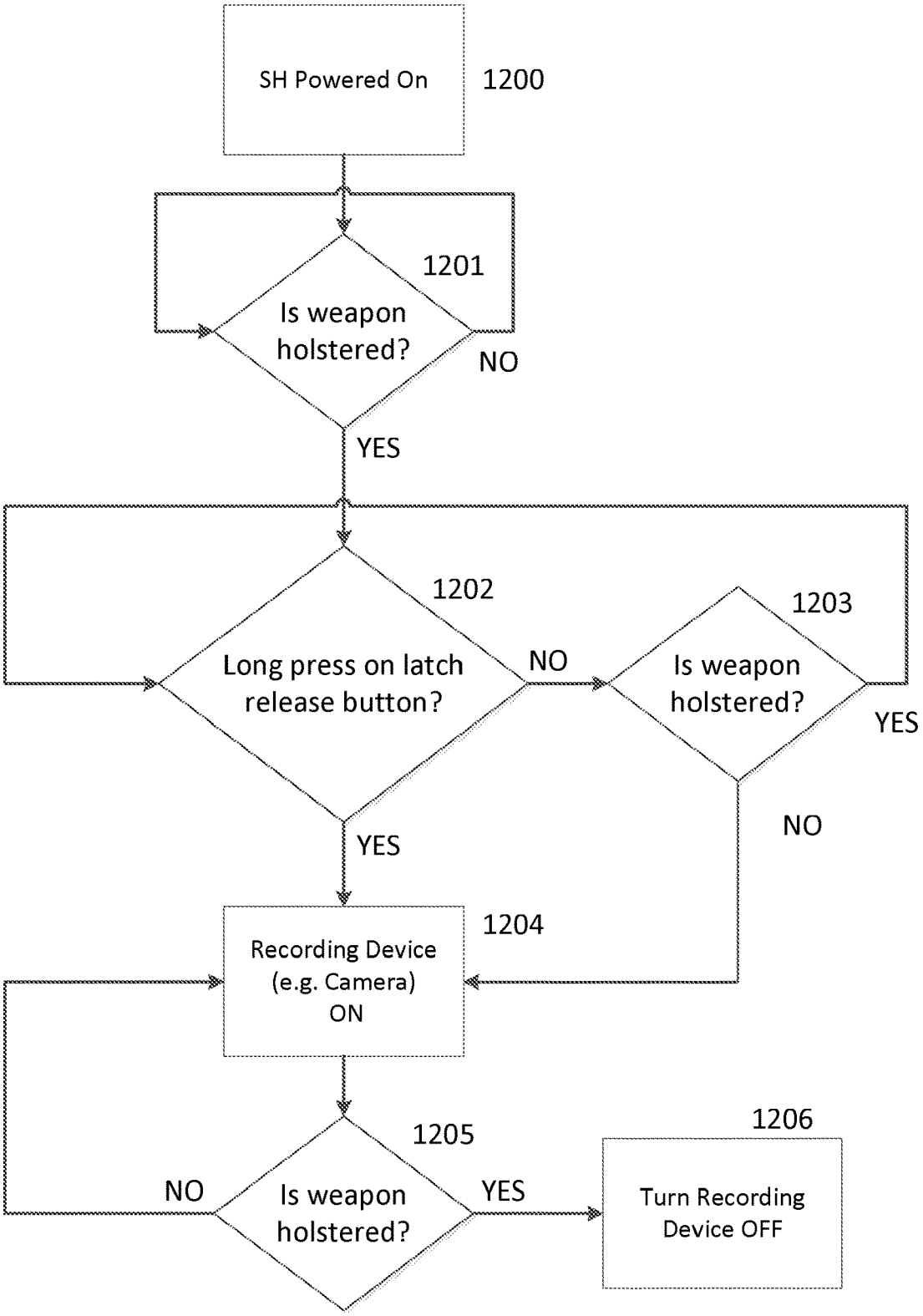
FIG. 19 depicts a flow diagram of automatic activation of a recording device such as a body camera or other recording device by the smart holster when the holster is unlatched or a weapon is removed therefrom.

Referring now to FIG. 19, a flow diagram of automatic activation of a recording device such as a body camera or other recording device by the smart holster when the holster is unlatched or a weapon is removed therefrom is depicted. The smart holster may be in communication with one or more sensors such as cameras or audio sensors, which may comprise microphones, through a communication port. The sensors may collect sensor information in the form or sensor signals which may be video signals, still image signals, or audio signals. After the smart holster is powered on 1200, controller 800 executes computer readable non transitory commands to read the state of the weapon present sensor 1201. If a weapon is not present, the controller continues to monitor the state of the weapon present sensor 1201. If a weapon is present in the holster, the controller monitors the latch release button sensor to determine whether latch release button 104 has been depressed in a "long press". The amount of time for determining a long press may be a predetermined value that is loaded into and stored in media 810, and make take any value such as two seconds, three seconds, or any other desired value. Thus, controller 800 is able to differentiate between a "long" press of latch release button 104 that meets or exceeds the predetermined value, and a "short" press of latch release button 104 that does not meets or exceed the predetermined value. If a long press of latch release button 104 is detected, 1202, a sensor or recording device such as a camera, audio sensor, or other recording device may be activated by controller 800 communicating an activation signal to such device wirelessly through a communication port, or via wires. The sensor or recording device may then begin to transmit sensor information in the form of video data, still image data, audio data or any other data to a remote monitoring station directly, or may communicate such data to the smart holster of the invention for transmission to a remote monitoring station through a communication port of the smart holster, or for storage in media 810 or any other media that may be in communication with the smart holster, or both. If a long press of latch release button 104 is not detected in step 1202, the controller checks the weapon present sensor to determine if the weapon remains in the holster 1203. If the weapon does not remain in the holster, a sensor or recording device such as a camera, audio sensor, or other sensor or recording device may be activated by controller 800 communicating an activation signal to such device wirelessly through a communication port or via wires 1204. The sensor or recording device may then begin to transmit sensor information in the form of video data, still image data, audio data or any other data to a remote monitoring station directly, or may communicate such data to the smart holster of the invention through a communication port for transmission to a remote monitoring station through a communication port of the smart holster, or for storage in media 810 or any other media that may be in communication with the smart holster, or any of the above. For example, in an embodiment, if it is determined that the direct communication link to a remote monitor from a sensor device such as a camera or audio sensor to the remote monitor is a weak signal, controller 800 may command the video data to be received by the smart holster through a communication port and transmitted to the remote monitoring station via a communication port, or stored in media 810, or both. If the weapon remains holstered 1203, the controller continues to monitor for a long press 1202. Once a weapon is returned to the smart holster 1205, the recording device is deactivated 1206, and the smart holster returns to monitoring state 1202. Thus controller 800, in an embodiment, may command a sensor such as a body camera 506 or audio source that is in communication with the controller to deactivate, or in other words to cease recording or transmitting video when a weapon is inserted into the smart holster of the invention, or when the holster is returned to a latched state. This feature eliminates the need for a law enforcement office to remember to place the body camera in an off state. Furthermore, the smart holster of the invention may receive a CAMERA ON signal from a camera 506 that is in communication with controller 800 either wired or wirelessly, and may report to the remote monitoring station that a law enforcement officer's camera has been activated. A sensor as described above produces a sensor signal, which may be, for example, a video or audio signal, or a signal that is a combination of both video and audio.

In any of the embodiments, the functions depicted in FIGS. 10-19 are optional functions, in any combination, in any embodiment. Furthermore the steps shown in the figures comprise optional steps, and the flow charts are exemplary of one embodiment of the invention.

A smart holster of the invention may be assigned a unique identifier such as, for example, a numeric or alphanumeric code. When a smart holster of the invention is assigned to person such as law enforcement officer, the unique code may be included with any communication of information provided to the remote monitoring station. Likewise, any information stored in media 810 may include the unique code. In this manner, the smart holster provides status, geolocation, video, audio, or sensor data that is unique to a specific person such as a law enforcement officer, eliminating the need to uniquely associate specific identifying information from a body camera with a specific officer. This allows the interchange of body cameras or microphones with the need to identify them to a specific officer or other person.

INDUSTRIAL APPLICABILITY

The present invention is useful for securing a firearm or other object in a holster that may be carried on a person's body or may be secured to any structure. The present invention further allows local or remote control over locking the smart holster such that access is denied to individuals who do not possess the proper code for unlocking, and for reporting the geographic location of the smart holster and the locked or unlocked status of the smart holster to a remote monitoring station. The smart holster may trigger the operation of certain safety or information-gathering devices such as cameras or microphones when a firearm is removed from the holster or when the holster is placed into an unlatched state, which information may be transmitted automatically to a remote monitoring station. The smart holster of the invention may be remotely locked to prevent access to a firearm, such as in an occurrence in which a law enforcement officer's smart holster has been acquired by an individual who is not authorized to access the weapon.

What is claimed is:

1. A smart holster, comprising:

a holster adapted to receive a weapon;

a rotating bail latching mechanism for latching said weapon into said holster, said rotating bail latching mechanism having a state, said state being defined as either being a latched state in which the rotating bail prevents removal of a weapon from said holster by physical contact with a rear surface of the weapon, or an unlatched state wherein a weapon may be removed from said holster when said rotating bail latching mechanism is in said unlatched state;

a latch release button operable to release said rotating bail latching mechanism into said unlatched state when said latch release button is manually depressed;

a controllable locking mechanism having a state, said state being defined as either a locked state in which said latch release button is prevented from being depressed, thus preventing said rotating bail latching mechanism from entering the unlatched state, and an unlocked state in which said latch release button is able to be depressed, thus allowing said rotating bail latching mechanism to enter the unlatched state, said controllable locking mechanism capable of being commanded to either said locked state or said unlocked state;

a controller for commanding said controllable locking mechanism into either said locked state or said unlocked state; and an input port in communication with said controller;

wherein said controllable locking mechanism is adapted to be commanded to said locked state or said unlocked state when a code is entered into said input port.

2. The smart holster of claim 1 in which the controllable locking mechanism is an electromechanical apparatus.

3. The smart holster of claim 1, further comprising a communication port in communication with said controller and adapted to wirelessly communicate with a remote electronic device, and wherein said controller is adapted to receive a command from said remote electronic device causing said controller to command said controllable locking mechanism to said locked or said unlocked state.

4. The smart holster of claim 3, wherein the remote electronic device is selected from the group consisting of a keyfob, cellular telephone, personal computer, or electronic tablet.

5. The smart holster of claim 1, further comprising a communication port in communication with said controller and adapted to wirelessly communicate with a remote monitoring station.

6. The smart holster of claim 5, wherein said controller is adapted to receive a command from said remote monitoring station causing said controller to command said controllable locking mechanism to said locked state.

7. The smart holster of claim 5, further comprising a locking mechanism sensor for sensing said locking mechanism state, said locking mechanism sensor in communication with said controller, and wherein said controller is adapted to cause said communication port to communicate said locking mechanism state to said remote monitoring station.

8. The smart holster of claim 5, further comprising a latching mechanism sensor for sensing said latching mechanism state, said latching mechanism sensor in communication with said controller, and wherein said controller is adapted to cause said communication port to communicate said latching mechanism state to said remote monitoring station.

9. The smart holster of claim 5, further comprising a weapon present sensor for sensing whether a weapon is present in said holster, said weapon present sensor in communication with said controller, and wherein said controller is adapted to cause said communication port to communicate a signal indicating whether or not a weapon is present in said holster to said remote monitoring station.

10. The smart holster of claim 5, further comprising a geolocation receiver for receiving geolocation signals and processing said signals to produce a geolocation information signal representing the geographic location of said smart holster, said geolocation receiver in communication with said controller.

11. The smart holster of claim 10, wherein said controller is adapted to transmit said geolocation information signal to said remote monitoring station through said communication port.

12. The smart holster of claim 5, wherein said controller is adapted to communicate an activation signal to at least one sensor for collecting sensor information, said signal to command said at least one sensor to transmit said sensor information to a remote monitoring station, when a long press is applied to a latch release button of the smart holster.

13. The smart holster of claim 12, wherein said sensor is a camera, and said sensor information is a video signal.

14. The smart holster of claim 12, wherein said sensor is a audio sensor, and said sensor information is an audio signal.

15. The smart holster of claim 5, further comprising a weapon present sensor in communication with said controller and producing a weapon present sensor signal, wherein said controller is adapted to communicate an activation signal to at least one sensor for collecting sensor information, said signal to command said at least one sensor to transmit said sensor information to a remote monitoring station, when said weapon present sensor signal indicates that there is no weapon present in said holster.

16. The smart holster of claim 15, wherein said sensor is a camera, and said sensor information is a video signal.

17. The smart holster of claim 15, wherein said sensor is a audio sensor, and said sensor information is an audio signal.

18. The smart holster of claim 5, wherein said controller is further adapted to receive a video signal containing video information from a camera through a communication port and wherein said controller is adapted to cause said communication port to communicate said video signal to said remote monitoring station when a long press is applied to a latch release button of the smart holster.

19. The smart holster of claim 5, further comprising a weapon present sensor in communication with said controller and producing a weapon present sensor signal, wherein said controller is adapted to receive a video signal containing video information from a camera through a communication port and wherein said controller is adapted to cause a communication port to communicate said video signal to said remote monitoring station when said weapon present sensor signal indicates that there is no weapon present in said holster.

20. The smart holster of claim 5, wherein said controller is further adapted to receive an audio signal containing audio information from an audio sensor through a communication port and wherein said controller is adapted to cause said communication port to communicate said audio signal to said remote monitoring station when a long press is applied to a latch release button of the smart holster.

21. The smart holster of claim 5, further comprising a weapon present sensor in communication with said controller and producing a weapon present sensor signal, wherein said controller is adapted to receive an audio signal containing audio information from a audio sensor through a communication port and wherein said controller is adapted to cause a communication port to communicate said audio signal to said remote monitoring station when said weapon present sensor signal indicates that there is no weapon present in said holster.

22. The smart holster of claim 5, further comprising an accelerometer in communication with said controller, said accelerometer producing a signal when said smart holster has been moved; wherein said non-transitory computer executable instructions further comprise instructions for receiving said accelerometer signal and transmitting a signal to said remote monitoring station indicating that said holster has been moved.

23. The smart holster of claim 5, further comprising a clip attached to an exterior surface of said holster, wherein said clip comprises a sensor for sensing when said belt clip is clipped onto a receiving structure and producing a clip sense signal corresponding to whether or not said clip is attached to a receiving structure, said sensor in communication with said controller.

24. The smart holster of claim 23, wherein said controller is adapted to cause said communication port to communicate said clip sense signal to said remote monitoring station.

25. The smart holster of claim 1 further comprising a geolocation radio frequency receiver for receiving geolocation signals and processing said signals to produce a geolocation information signal representing the geographic location of said smart holster, said geolocation radio frequency receiver in communication with said controller.

26. The smart holster of claim 25, wherein said controller is adapted to cause said geolocation information signal or said geographic location to be stored in said computer readable media.

27. The smart holster of claim 1, wherein said controller is further adapted to receive a sensor signal containing video information from a camera and wherein said controller is adapted to cause said video signal or said video information to be stored in said computer readable media.

28. The smart holster of claim 27, further comprising a weapon present sensor for sensing whether a weapon is present in said holster, said weapon present sensor in communication with said controller, and wherein said controller is adapted to cause said video signal or said video information to be stored in said computer readable media when a weapon has been removed from said holster.

29. The smart holster of claim 27, wherein said controller is adapted to cause said video signal or said video information to be stored in said computer readable media when a long press is applied to a latch release button of the smart holster.

30. The smart holster of claim 1, wherein said controller is further adapted to receive an audio signal containing audio information from an audio sensor and wherein said controller is adapted to cause said audio signal or said audio information to be stored in said computer readable media.

31. The smart holster of claim 30, further comprising a sensor for sensing whether a weapon when a weapon has been removed from said holster in communication with said controller wherein said controller is adapted to cause said audio signal or said audio information to be stored in said computer readable media when a weapon has been removed from said holster.

32. The smart holster of claim 1, further comprising a communication port for communicating with an external key fob comprising an RFID tag; wherein said non-transitory computer executable instructions further comprise instructions for commanding said transceiver to search for said RFID tag and to command said locking mechanism into said locked state when said RFID tag is not found.

33. A method for monitoring or controlling the status of a weapon in a holster, comprising:

providing a holster for holding a weapon, said holster capable of being latched so that a weapon disposed in said holster cannot be removed from said holster when said holster is in said latched state;

sensing whether a weapon is present in said holster; and activating a sensor when said latch is operated into an unlatched state by a long press of a latch release button, if a weapon is present in said holster, said sensor producing sensor information.

34. The method for monitoring or controlling the status of a weapon in a holster of claim 33, wherein said sensor is a body camera, wherein said sensor information is further defined as a video signal, and wherein said activation is further defined as comprising the step of transmitting said video signal from said body camera to a remote monitoring site.

35. The method for monitoring or controlling the status of a weapon in a holster of claim 34, further comprising the steps of communicating said video signal to a controller of said holster wherein said controller is in communication with a storage media, and storing said video signal in said media.

36. The method for monitoring or controlling the status of a weapon in a holster of claim 34, further comprising the step of terminating said transmission of video data when said holster is returned to a latched state.

37. The method for monitoring or controlling the status of a weapon in a holster of claim 33, wherein said sensor is an audio source, and wherein said activation is further defined as the step of transmitting an audio signal from said audio source to a remote monitoring site.

38. The method for monitoring or controlling the status of a weapon in a holster of claim 37, further comprising the steps of communicating said audio signal to a controller of said holster wherein said controller is in communication with a storage media, and storing said audio signal in said media.

39. The method for monitoring or controlling the status of a weapon in a holster of claim 37, further comprising the step of terminating said transmission of audio data when said holster is returned to a latched state.

40. A method for monitoring or controlling the status of a weapon in a holster, comprising:

providing a holster for holding a weapon, wherein said holster comprises;

a rotating bail latching mechanism for latching said weapon in said holster, said rotating bail latching mechanism having a state, said state being defined as either being a latched state in which the rotating bail prevents removal of a weapon from said holster by physical contact with a rear surface of the weapon, or an unlatched state wherein a weapon may be removed from said holster when said rotating bail latching mechanism is in said unlatched state;

a latch release button operable to release said rotating bail latching mechanism into said unlatched state when said latch release button is manually depressed;

a controllable locking mechanism having a state, said state being defined as either a locked state in which said latch release button is prevented from being depressed, thus preventing said rotating bail latching mechanism from entering the unlatched state, and an unlocked state in which said latch release button is able to be depressed, thus allowing said rotating bail latching mechanism to enter the unlatched state, said controllable locking mechanism capable of being commanded to either said locked state or said unlocked state;

a controller for commanding said controllable locking mechanism into either said locked state or said unlocked state; and an input port in communication with said controller;

wherein said controllable locking mechanism is adapted to be commanded to said locked state or said unlocked state when a code is entered into said input port sensing whether a weapon is present in said holster; and activating a sensor when a weapon is removed from said holster, said sensor producing sensor information.

41. The method for monitoring or controlling the status of a weapon in a holster of claim 40, wherein said sensor is a body camera, wherein said sensor information is further defined as a video signal, and wherein said activation is further defined as comprising the step of transmitting said video signal from said body camera to a remote monitoring site.

42. The method for monitoring or controlling the status of a weapon in a holster of claim 41, further comprising the steps of communicating said video signal to a controller of said holster wherein said controller is in communication with a storage media, and storing said video signal in said media.

43. The method for monitoring or controlling the status of a weapon in a holster of claim 41, further comprising the step of terminating said transmission of video data when a weapon is returned to said holster.

44. The method for monitoring or controlling the status of a weapon in a holster of claim 40, wherein said sensor is an audio source, and wherein said activation is further defined as the step of transmitting an audio signal from said audio source to a remote monitoring site.

45. The method for monitoring or controlling the status of a weapon in a holster of claim 44, further comprising the steps of communicating said audio signal to a controller of said holster wherein said controller is in communication with a storage media, and storing said audio signal in said media.

46. The method for monitoring or controlling the status of a weapon in a holster of claim 44, further comprising the step of terminating said transmission of audio data when a weapon is returned to said holster.

* * * * *